US011767687B2

(12) United States Patent
Laporta

(10) Patent No.: US 11,767,687 B2
(45) Date of Patent: Sep. 26, 2023

(54) HANDLE ASSEMBLY FOR A WINDOW OR DOOR LEAF

(71) Applicant: Giovanni Laporta, Watford (GB)

(72) Inventor: Giovanni Laporta, Watford (GB)

(73) Assignee: Giovanni Laporta, Watford (GB)

( * ) Notice: Subject to any disclaimer, the term of this patent is extended or adjusted under 35 U.S.C. 154(b) by 170 days.

(21) Appl. No.: 16/976,227

(22) PCT Filed: Feb. 27, 2019

(86) PCT No.: PCT/GB2019/050541
§ 371 (c)(1),
(2) Date: Aug. 27, 2020

(87) PCT Pub. No.: WO2019/166800
PCT Pub. Date: Sep. 6, 2019

(65) Prior Publication Data

US 2021/0032900 A1 Feb. 4, 2021

(30) Foreign Application Priority Data

Feb. 27, 2018 (GB) ..... 1803211

(51) Int. Cl.
*E05B 63/16* (2006.01)
*E05B 55/06* (2006.01)
(Continued)

(52) U.S. Cl.
CPC ..... *E05B 63/16* (2013.01); *E05B 13/007* (2013.01); *E05B 13/101* (2013.01);
(Continued)

(58) Field of Classification Search
CPC ..... E05B 13/005; E05B 13/007; E05B 13/10; E05B 13/101; E05B 13/105; E05B 55/00;
(Continued)

(56) References Cited

U.S. PATENT DOCUMENTS 2,702,204 A * 2/1955 Collier ..... E05B 13/005 292/358
5,947,535 A * 9/1999 Baker ..... E05C 1/12 292/336.5
(Continued)

FOREIGN PATENT DOCUMENTS

DE 3844281 A1 6/1989
FR 746727 6/1933
(Continued)

*Primary Examiner* — Christopher J Boswell
(74) *Attorney, Agent, or Firm* — Traverse Legal, PLC

(57) ABSTRACT

A handle assembly for a window or door leaf having first and second opposing sides, the handle assembly having a forward end and a rearward end, the handle assembly comprising: a first handle grip, configured for mounting to a first side of the leaf, the first handle grip being moveable rotatably and axially relative to a first handle axis, and a second handle grip configured for mounting to the second side of the leaf, the second handle grip being movable at least rotatably relative to a second handle axis, each handle grip having a closed position, wherein the handle grip is in a first angular position and an open position, wherein the handle grip is in a second angular position, the handle assembly having a rest mode and a locked mode.

23 Claims, 12 Drawing Sheets

(51) Int. Cl.

| | |
|---|---|
| ***E05B 13/00*** | (2006.01) |
| ***E05B 13/10*** | (2006.01) |
| ***E05B 15/00*** | (2006.01) |
| ***E05C 1/14*** | (2006.01) |

(52) U.S. Cl.
CPC ..... *E05B 13/105* (2013.01); *E05B 15/0033* (2013.01); *E05B 55/06* (2013.01); *E05C 1/14* (2013.01)

(58) Field of Classification Search
CPC ..... E05B 55/06; E05B 63/16; E05B 63/22; E05C 1/12; E05C 1/14
See application file for complete search history.

(56) References Cited

U.S. PATENT DOCUMENTS

| | | | | |
|---|---|---|---|---|
| 9,371,671 | B2 * | 6/2016 | Weathersby | E05C 1/14 |
| 10,458,149 | B2 * | 10/2019 | Densmore | E05B 13/005 |
| 10,711,485 | B2 * | 7/2020 | Li | E05B 13/105 |
| 10,837,199 | B2 * | 11/2020 | Ou | E05B 15/10 |
| 2006/0022011 | A1 * | 2/2006 | Ceravalls Pujol | B25C 1/18 227/8 |
| 2009/0282652 | A1 * | 11/2009 | Maramba | E05B 13/005 16/441 |
| 2019/0234108 | A1 * | 8/2019 | Li | E05B 15/0033 |
| 2020/0115921 | A1 * | 4/2020 | Alber | E05B 13/005 |

FOREIGN PATENT DOCUMENTS

| | | | |
|---|---|---|---|
| GB | 1014173 | A | 12/1965 |
| GB | 1072110 | A | 6/1967 |
| GB | 1474652 | A | 5/1977 |
| GB | 2241282 | A | 8/1991 |
| GB | 2206639 | B | 12/1991 |
| GB | 2255798 | A | 11/1992 |
| WO | 2006/030038 | A1 | 3/2006 |
| WO | 2006/086855 | A1 | 8/2006 |

* cited by examiner 10
20
11
14
13
26
15
12
OUTSIDE
INSIDE 10
14
51
15

13
51
8
Lock Drive Cam
13a 51
8

20
14

32
31
30

20
32
14

OUTSIDE

INSIDE 400
414
415
423
441
432
460
440
445
444
INSIDE 423
430
432
431

414
407
408a
408b
415
Ride Over Spring
INSIDE
OUTSIDE

A
F
407
413a
408a
408
408b
Unlocked
INSIDE
OUTSIDE

HANDLE ASSEMBLY FOR A WINDOW OR DOOR LEAF

PRIORITY APPLICATION

This application claims the benefit of International Patent Application No. PCT/GB2019/050541, filed Feb. 27, 2019 and UK Patent Application No. 1803211.0, filed Feb. 27, 2018, the entire contents of which are incorporated herein by reference.

FIELD OF THE INVENTION

The present invention relates to handle assemblies for door or window leaves. In particular it relates to handle assemblies having means for locking the assembly from the inside to prevent entry from outside.

BACKGROUND TO THE INVENTION

Doors typically have latch mechanisms for holding the door closed by means of a latch which engages in a recess or keep in the door jamb. Windows can have similar latch mechanisms. Such latch mechanisms are typically operated by means of a handle (usually either a lever type handle or knob type handle).

Handle assemblies for interior doors sometimes include a "privacy" locking function. This facility is generally required in toilets, bathrooms and bedrooms where the occupant is able to activate the locking function to prevent the accidental intrusion of other persons. The privacy locking function is typically provided by a locking button on the internal side of the handle assembly that when actuated prevents opening of the door. Privacy locking buttons can be unsightly.

Handle assemblies for exterior doors typically include a lockable latch or a separate deadbolt. The lockable latch or separate deadbolt is usually locked and unlocked from the outside or inside using a key. It is inconvenient to require use of a key when locking and unlocking a lock from the inside.

An alternative mechanism for locking exterior or interior doors or windows from the inside would be useful.

SUMMARY OF THE INVENTION

According to a first aspect of the invention there is provided a handle assembly for a window or door leaf having first and second opposing sides, the handle assembly having a forward end and a rearward end, the handle assembly comprising: a first handle grip, configured for mounting to a first side of the leaf, the first handle grip being moveable rotatably and axially relative to a first handle axis, and a second handle grip configured for mounting to the second side of the leaf, the second handle grip being movable at least rotatably relative to a second handle axis, each handle grip having a closed position, wherein the handle grip is in a first angular position and an open position, wherein the handle grip is in a second angular position, the handle assembly having a rest mode in which at least the second handle grip is configured for driving a latch means between a latched position and a released position, and locked mode in which the second handle grip is prevented from being operable to drive the latch means, wherein the handle assembly is configured such that the handle assembly is transformed between the rest mode and the locked mode by moving at least a part of the handle assembly at least axially along the first handle axis or along an axis parallel with the first handle axis.

In preferred embodiments the handle assembly is transformed between the rest mode and the locked mode at least by moving at least a part of the handle assembly axially along the first handle axis. The handle assembly can therefore be locked at least by axial movement of part of the handle assembly, such as the first handle grip, to convert the handle assembly to the locked mode such that the latch means cannot be driven by the second handle grip until the handle assembly is unlocked by movement of said part of the handle assembly at least axially to convert the handle assembly to the rest mode. Prior art handle assemblies typically have handles that are secured by a fixing clip or washer and do not move forwards or backwards, as shown in FIGS. 1A and 1B. In preferred embodiments the handle assembly can be locked from the first side of the leaf by moving the first handle grip axially such that when locked, the leaf cannot be opened from the second side until the handle assembly is unlocked by moving the first handle grip axially the other way. For example, in a preferred embodiment, pushing in of the first handle grip locks out the second handle grip from opening the latch means. This means that for internal doors a separate privacy lock button is not required to be incorporated into the handle assembly, unlike prior art systems which have unsightly privacy lock buttons. For external doors, this provides an easy way to lock the door from the inside so that the external handle cannot be used to operate the door latch to gain entry. This means that a separate action of locking the door from the inside using a key is not needed. A separate lock operated by a key may of course be included on the door to provide added security in addition to the locking function described above. In certain embodiments the first and second handle axes may be coaxial. In preferred embodiments the handle assembly further comprises biasing means to bias the first handle grip to its closed position. Said biasing means may bias the second handle grip to its closed position, or the handle assembly may include separate biasing means to bias the second handle grip to its closed position. The second handle grip may be moveable axially as well as rotatably.

Preferably the handle assembly is configured such that it is transformable from the rest mode to the locked mode by one of moving the first handle grip axially forwards relative to the leaf and axially rearwards relative to the leaf. In preferred embodiments the handle assembly is configured such that it is transformable from the rest mode to the locked mode by moving the first handle grip axially forwards relative to the leaf.

In certain embodiments the handle assembly further comprises a first spindle that is rotated upon rotation of the first handle grip and a second spindle that is rotated upon rotation of the second handle grip, each spindle being engageable with a drive mechanism for driving the latch means, wherein the handle assembly is configured such that transformation of the handle assembly from the rest mode to the locked mode causes the second spindle to be disengaged from the drive mechanism.

Preferably transformation of the handle assembly from the rest mode to the locked mode causes the second spindle to be pushed forwards, disengaging the second spindle from the drive mechanism. This type of handle assembly can be used for a standard type latch where the user has to press the handle lever down to actuate the latch or lock. In preferred embodiments the first handle grip is an internal handle grip and the assembly is configured such that movement of the first handle grip axially transforms the handle assembly from rest mode to locked mode. This provides an easy way to lock the door to prevent others from gaining entry from outside. A user of this system will not accidentally lock themselves out as the handle assembly does not remain locked after a user has used the first handle grip to exit the door (as the handle assembly would return to rest mode).

Preferably transformation of the handle assembly from the rest mode to the locked mode causes the second spindle to be pushed forwards by forwards movement of the first spindle. In preferred embodiments the handle assembly is transformed from the rest mode to the locked mode by pushing the handle grip axially forwards relative to the leaf, which in turn causes the first spindle to move axially forwards, pushing the second spindle forwards such that it is disengaged from the drive mechanism.

Preferably the first spindle has a forward end that is received in a first end of a spindle bore of the drive mechanism and the second spindle has a rearward end that is received in a second end of the spindle bore, the second spindle having a first portion at its rearward end, the first portion having a cross-section shaped so as not to engage with the spindle bore when received therein, and a second portion adjacent the first portion, the second portion having a cross-section shaped to engage with the spindle bore when received therein via keying engagement. When the second portion of the second spindle is received in the spindle bore, rotation of the second spindle will operate the drive mechanism by means of the keying engagement of the second portion in the spindle bore, whereas when the first portion of the second spindle but not the second portion is received in the spindle bore, rotation of the second spindle will not operate the drive mechanism. When the first portion of the second spindle but not the second portion is received in the spindle bore, the second spindle may rotate freely within the spindle bore without operating the drive mechanism as the first portion does not key with the spindle bore. The second portion of the second spindle is preferably non-circular in cross-section. When the assembly is in rest mode the first portion and at least part of the second portion of the second spindle will be received in the spindle bore. Transformation of the assembly to the locked mode pushes the second spindle forwards, displacing the second portion of the second spindle from the spindle bore. This disengages the second spindle from the drive mechanism.

Preferably the first portion of the second spindle has a round cross-section and the second portion has a square cross-section.

Preferably the handle assembly further comprises biasing means to bias the second handle grip rearwardly. Preferably the biasing means comprises a spring. The handle assembly may further comprise biasing means to bias the first handle grip rearwardly. The biasing means may be a spring.

Preferably the handle assembly further comprises retaining means for retaining the handle assembly in the locked mode.

Preferably the retaining means comprises a first element mounted in rigid association with the first handle grip in use and a second element mounted in rigid association with the leaf in use, the first element and second element being adapted to cooperate with one another via magnetic attraction. In preferred embodiments the first element is arranged such that it is carried by the first handle grip as the first handle grip is moved relative to the leaf. When the handle assembly is transformed from its rest mode to its locked mode the first element will be moved into contact or into close proximity with the second element and the first element will be retained in this position via magnetic attraction between the first element and the second element. Preferably one of the first and second elements is magnetic and the other of the first and second elements is ferromagnetic.

In other embodiments the retaining means comprises a mechanical clip means for retaining the first handle grip in rigid association relative to the leaf in order to retain the handle assembly in the locked mode. The mechanical clip means may retain the first handle grip in rigid association relative to the leaf, for example via some sort of friction means.

In certain embodiments the handle assembly is configured such that in order to transform the handle assembly from the rest mode to the locked mode the first handle grip is moved axially along the first handle axis then rotated.

Preferably the forward end of the first spindle has a cross-section shaped to engage with the spindle bore when received therein via keying engagement such that rotation of the first spindle when engaged in the spindle bore rotates a collar of the drive mechanism in which the spindle bore is located, the second spindle having at least a portion having a cross-section shaped to engage with the spindle bore when received therein via keying engagement such that rotation of the second spindle when engaged in the spindle bore rotates the collar, wherein the handle assembly is configured such that the handle assembly is transformed from the rest mode to the locked mode by moving the first handle grip axially along the first handle axis then rotating the first handle grip such that the collar is rotated out of alignment with said at least a portion of the second spindle whereby the second spindle cannot engage with the spindle bore when the assembly is in the locked mode.

In certain embodiments the handle assembly may be configured such that in order to transform the handle assembly from the rest mode to the locked mode the first handle grip is simply rotated (without needing to first axially move the first handle grip). In such embodiments the assembly can be transformed from rest mode to locked mode by rotating the first handle grip to rotate the collar out of alignment with at least a portion of the second spindle that is engageable via keying engagement in the spindle bore so that said portion cannot engage with the misaligned collar.

Preferably the second spindle has a first portion at its rearward end, the first portion having a cross-section shaped so as not to engage with the spindle bore when received therein, said at least a portion of the second spindle shaped to engage with the spindle bore being a second portion of the spindle adjacent the first portion.

Preferably the first handle grip has a third angular position, wherein when the first handle grip is moved into its third position, the handle assembly is configured such that it is retained in the locked mode until the first handle grip is moved away from its third position. The handle assembly may be configured such that movement of the first handle grip into its third position also actuates multi-point locks of a multi-point lock system.

Preferably the first handle grip is moveable into its third position by moving the first handle grip rotatably relative to the handle assembly. In preferred embodiments the first handle grip is lifted rotatably towards the top of the leaf from its closed position into its third position.

Preferably the handle assembly further comprises at least a first blocking means transformable between a first blocking configuration and a non-blocking configuration, wherein in the first or each blocking configuration rotation of the first handle grip is limited, and wherein the handle assembly is configured such that the blocking means is transformed between the first or each blocking configuration and the non-blocking configuration by moving the first handle grip axially along the first handle axis. In the non-blocking configuration at least the first handle grip is free to be rotated. When the blocking means is in a blocking configuration at least the first handle grip is prevented from moving away from a predetermined position. In preferred embodiments the handle assembly further comprises biasing means to bias the blocking means away from the non-blocking configuration.

Preferably the blocking means comprises at least a first stop member and at least a first blocking formation, the at least a first blocking formation being coupled to the first handle grip for movement therewith, the first blocking formation being contactable with the first stop member when the blocking means is in its first blocking configuration, thereby limiting rotation of the first handle grip.

Preferably said blocking formation comprises a protrusion projecting radially along the first handle axis.

Preferably the handle assembly further comprises a housing, the first handle grip being moveable rotatably and axially relative to the housing, the blocking formation being housed within said housing in use. For a blocking means on the internal side of the handle assembly, the housing will be on the internal side of the handle assembly. A handle assembly may additionally or alternatively have blocking means on the external side of the handle assembly, in which case the housing referred to above will be on the external side of the handle assembly.

Preferably the handle assembly further comprises a rotatable body arranged such that it rotates upon rotation of the first handle grip, the protrusion projecting radially from the rotatable body. Suitably the rotatable body is arranged such that it is coaxial with the first handle axis.

Preferably the first stop member is located on the housing and is configured for contacting the first blocking formation when the blocking means is in the first blocking configuration. Preferably the first stop member is mounted to or integral with an inside surface of the housing.

In certain embodiments said first blocking configuration is a locked blocking configuration in which at least the first handle grip is prevented from being rotated away from its third position by the blocking means. Suitably the housing has a stop member located for contacting the blocking formation to prevent the first handle grip from being rotated away from its third position when the blocking means is in the locked blocking configuration.

Preferably the blocking means is a retaining means for retaining the handle assembly in the locked mode. Once the blocking means has been transformed into the locked blocking mode, the first handle grip must be moved axially forwards in order to move the blocking means out of the locked blocking mode. In certain embodiments the blocking means is in the locked blocking configuration when the handle assembly is in its locked mode and the blocking means is in the non-blocking configuration as the handle assembly is being moved between the locked mode and the rest mode.

Preferably the blocking means is further transformable into a child safety blocking configuration in which at least the first handle grip is prevented from being rotated away from its closed position by the blocking means. The child safety blocking configuration is a second blocking configuration. Suitably the housing has a stop member located for contacting the blocking formation when the blocking means is in the child safety blocking configuration. In certain embodiments the handle assembly is in the child safety blocking configuration when the handle assembly is in the rest mode.

In certain embodiments the handle assembly further comprises a button mounted on the first side of the leaf in use, wherein the handle assembly is configured such that actuation of the button transforms the assembly from rest mode to locked mode. Preferably the button is configured to be actuated by pushing it forward relative to the leaf. Preferably transformation of the handle assembly from the rest mode to the locked mode causes the second spindle to be pushed forwards by pushing of the button forwards relative to the leaf.

In certain embodiments the handle assembly comprises spindle means that rotatably couples the first and second handle grips in use such that the first and second handle axes are coaxial and align with a handle axis, wherein the assembly further comprises a first blocking means transformable between a first blocking configuration and a non-blocking configuration, wherein in the first blocking configuration the first and second handle grips are prevented from being rotated, and wherein the handle assembly is configured such that the blocking means is transformed between the blocking configuration and the non-blocking configuration by moving the first handle grip axially along the handle axis. In certain embodiments the blocking means is in the non-blocking configuration when the handle assembly is in its rest mode and the blocking means is in the blocking configuration when the handle assembly is in its locked mode.

Preferably the handle assembly is configured such that the blocking means is transformed from the non-blocking configuration to the blocking configuration by moving the first handle grip forwards axially along the handle axis.

The handle assembly may further comprise indicator means to indicate to a user whether the handle assembly is in the rest mode or the locked mode.

Preferably the indicator means is a visual indicator means comprising a rest mode indicator on the first side of the leaf which if visible indicates that the handle assembly is in the rest mode, whereby movement of the first handle grip during transformation of the handle assembly between the rest mode and the locked mode alters the extent to which the rest mode indicator is visible to the user in order to visually indicate whether handle assembly is in the rest mode. When the handle assembly is moved from rest mode into locked mode, the rest mode indicator is covered by the first handle grip. When the handle assembly is moved from locked mode into rest mode, the rest mode indicator is uncovered by the first handle grip.

Preferably the indicator means is a visual indicator means comprising a locked mode indicator on the second side of the leaf which if visible indicates that the handle assembly is in the locked mode, whereby movement of the second handle grip during transformation of the handle assembly between the rest mode and the locked mode alters the extent to which the locked mode indicator is visible to the user in order to visually indicate whether handle assembly is in the locked mode. When the handle assembly is moved from rest mode into locked mode, the locked mode indicator is uncovered by the first handle grip. When the handle assembly is moved from locked mode into rest mode, the rest mode indicator is covered by the first handle grip.

Preferably the locked mode indicator is moveable between a first position in which it is substantially covered from view by the second handle grip and a second position in which it protrudes from the second handle grip, wherein the handle assembly is configured such that transformation of the handle assembly from the rest mode to the locked mode causes the spindle means to be pushed forwards by forward movement of the first handle grip, whereby the spindle means pushes the locked mode indicator from its first position to its second position. In preferred embodiments the locked mode indicator is biased towards its first position.

The indicator means may be an electrical indicator means. Preferably the handle assembly further comprises a switch means that actuates an electrical indicator, wherein the handle assembly is configured such that transformation of the handle assembly from the rest mode to the locked mode causes the spindle means to be pushed forwards by forward movement of the first handle grip, which in turn activates the switch means to actuate the electrical indicator. The electrical indicator may be an audible indicator or illuminating indicator. For example, the handle assembly may include a speaker to produce an audible sound when the switch is activated or include an LED that illuminates whilst the switch is activated.

Preferably the handle assembly further comprises spindle means that is rotated upon rotation of the first and/or second handle grip, the spindle means having a sacrificial portion and a remainder portion, the sacrificial portion being configured for breaking away from the remainder portion if an attempt is made to snap the spindle means.

According to a further aspect of the invention there is provided a spindle means for a handle assembly, the spindle means having a sacrificial portion and a remainder portion, the sacrificial portion being configured for breaking away from the remainder portion if an attempt is made to snap the spindle means. The sacrificial portion is preferably at the forward end of the spindle means.

According to a further aspect of the invention there is provided a kit for a handle assembly according to any aspect of the invention described above.

The term "engage" as used herein refers to interlocking or mating of components and "disengage" refers to unmating or mechanical uncoupling of components.

In the context of the present invention, the term "mounting" means connecting or joining, either directly or by means of an intermediate or auxiliary element.

It is to be understood that the mere use of the term "first" does not require that there be any "second," and the mere use of the term "second" does not require that there be any "third," etc.

BRIEF DESCRIPTION OF THE DRAWINGS

Embodiments of the invention will now be described by way of example only, with reference to the accompanying drawings, in which:

FIGS. 2 to 5D show a handle assembly for a multi-point lock system according to a first embodiment of the invention;

FIG. 2 is an exploded view of the handle assembly;

FIG. 3A is a perspective view of the handle assembly in rest mode;

FIG. 3B is a perspective view of the handle assembly of FIG. 3A in a locked mode;

FIG. 3C is a cutaway view of the second spindle and collar when the handle assembly is in locked mode;

FIG. 3D is a close-up view of the second spindle and collar when the handle assembly in a locked mode;

FIG. 3E is a cutaway view of the first handle grip and inner housing, the handle assembly being in rest mode;

FIG. 3F shows the parts of FIG. 3E, the first handle grip having been pushed in;

FIG. 3G shows the parts of FIG. 3E, the first handle grip having been moved to its third position;

FIG. 4A is a cutaway view of the inner housing;

FIG. 4B is a close-up view of the inner housing;

FIG. 4C is a cutaway view of the first handle grip and inner housing, the handle assembly being in rest mode;

FIG. 4D shows the parts of FIG. 4C, the first handle grip having been pushed in;

FIG. 4E shows the configuration of the latch means when the handle assembly is in the FIG. 4D configuration;

FIG. 4F shows the parts of FIG. 4C, the first handle grip having been moved to its third position;

FIG. 4G shows the configuration of the latch means when the handle assembly is in the FIG. 4F configuration;

FIG. 5D shows the configuration of the first handle grip when the handle assembly is in the FIG. 5B configuration;

FIG. 6A is a cross-sectional view of the handle assembly in rest mode;

FIG. 6B is a cross-sectional view of the handle assembly in locked mode;

FIG. 6C is a perspective view of the handle assembly;

FIGS. 7 to 8D show a handle assembly for a standard type latch mechanism according to a further embodiment of the invention;

FIG. 7 shows an exploded view of the handle assembly;

FIG. 8D shows a cutaway of the first handle grip and inner housing when the handle assembly is in the locked mode;

FIG. 9A shows a perspective view of the handle assembly in rest mode;

FIG. 9B shows a cutaway view of the handle assembly in rest mode;

FIG. 9C shows a cross-sectional view of the handle assembly in rest mode;

FIG. 9D shows a cutaway view of the handle assembly in locked mode;

FIG. 9E shows a cross-sectional view of the handle assembly in locked mode;

FIG. 10A shows a perspective view of the handle assembly in rest mode;

FIG. 10B shows a cutaway view of the handle assembly in rest mode;

FIG. 10C shows a cross-sectional view of the handle assembly in rest mode;

FIG. 10D shows a cutaway view of the handle assembly in locked mode;

FIG. 10E shows a cross-sectional view of the handle assembly in locked mode;

FIG. 11A shows a side view of the handle assembly in locked mode;

FIG. 11B shows a cross-sectional view of the handle assembly;

FIG. 11C shows a side view of the handle assembly in rest mode;

DESCRIPTION OF THE PREFERRED EMBODIMENTS

Figure 1B:
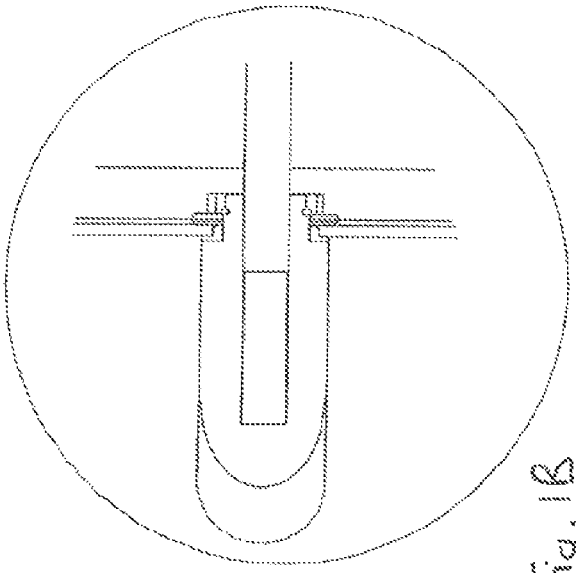
Fig. 1B PRIOR ART
FIG. 1B is a close-up view of a handle grip of the prior art handle assembly of FIG. 1A.

The present embodiments represent currently the best ways known to the applicant of putting the invention into practice. But they are not the only ways in which this can be achieved. They are illustrated, and they will now be described, by way of example only. Common features between the assemblies of the different figures are referenced by common reference numerals.

Figures 3A, 3B, 3C, 3D, 3E, 3F, 3G:
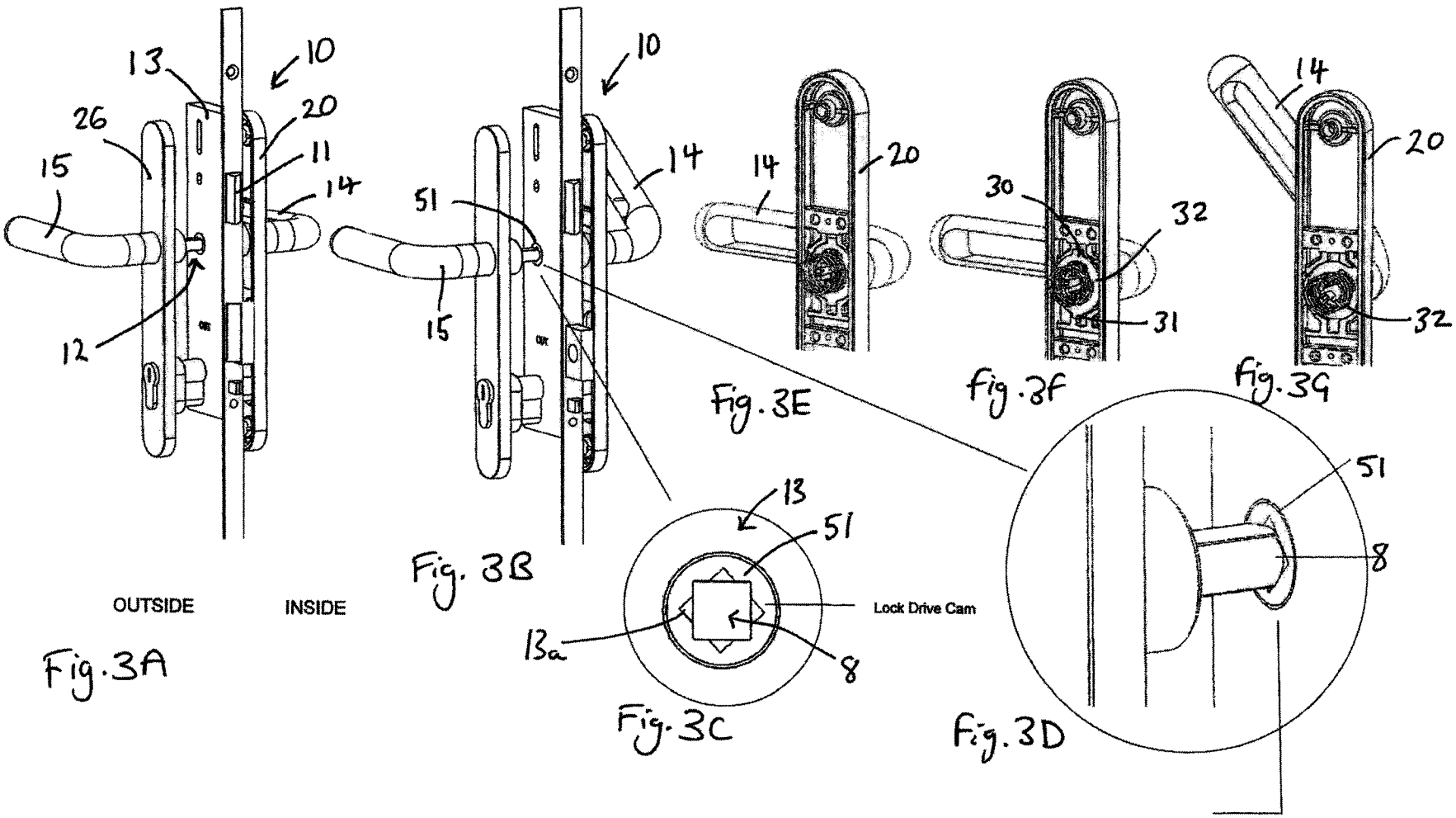

FIG. 3A shows some features of a typical handle assembly 10 for a window or door leaf that are common between the embodiments of the present invention described herein. The handle assembly 10 is designed for use with spindle means 12 which drives a latch means 11 mounted to a leaf (not shown) and which is engageable with a retainer or catch (not shown) on an adjacent door jamb to latch the door in its closed position. The latch means 11 can be withdrawn to permit opening of the door by turning of the spindle means 12, which is driven by at least a first handle grip 14 coupled to the spindle means 12 such that rotation of the first handle grip 14 rotates at least part of the spindle means 12. Typically the latch means 11 is spring biased into its latched position in which it is engaged with the retainer or catch in the door jamb. The spindle means 12 is coupled to the latch means 11 by a conventional drive mechanism 13 for driving the latch means 11, such as a gearbox, which operates to retract or withdraw the latch means upon rotation of the spindle means 12, disengaging the latch means 11 from the cooperating retainer or catch, thereby permitting the door to be opened.

The first handle grip 14 is for mounting to a first side of a leaf (not shown). The handle assembly includes a second handle grip 15, for mounting to a second, opposing side of the leaf, as shown in the assembly 10 of FIG. 3A. The leaf has an 'internal' side and an 'external' side. The leaf may be in the external perimeter of a building, in which case the external side of the leaf faces outside. Alternatively, the leaf may be an internal door, for example with its internal side facing the inside of a bathroom or bedroom. The handle assemblies of the present invention are lockable from the internal side so as to prevent people from being able to enter via the leaf from the external side by operating the second handle grip 15. The first handle grip 14 is mounted to a housing plate 20 that houses certain parts of the assembly and which is referred to herein as the internal housing 20 (a housing is not essential, but is a preferred feature). The internal housing 20 is mounted to the leaf by suitable means such as suitable fixings. The internal handle grip 14 has a forward end (which could also be referred to as an outward end) that faces towards the leaf when assembled and a rearward end (which could also be referred to as an inward end) that faces away from the leaf when assembled. The external handle grip 15 has a forward end that faces away from the leaf and a rearward end that faces towards the leaf when assembled. The second handle grip 15 is mounted to a housing plate 26 that houses parts of the assembly and which is referred to herein as the external housing 26.

As will be further described below, each handle assembly of the invention has a rest mode in which at least the second handle grip may be used for driving the latch means between a latched position and a released position. The handle assembly also has a locked mode in which the handle assembly is configured so that the second handle grip is prevented from being operable to drive the latch means. In the locked mode for example, the second handle grip may be blocked from rotating, or it may be rotatable, but not engaged with the drive mechanism. In some embodiments the handle assembly can be converted from the rest mode to the locked mode by pushing or pulling the first handle grip relative to the leaf. In other embodiments the handle assembly can be converted from the rest mode to the locked mode by pushing or pulling another element of the handle assembly relative to the leaf. Further details of various embodiments will be described below.

Figure 2:
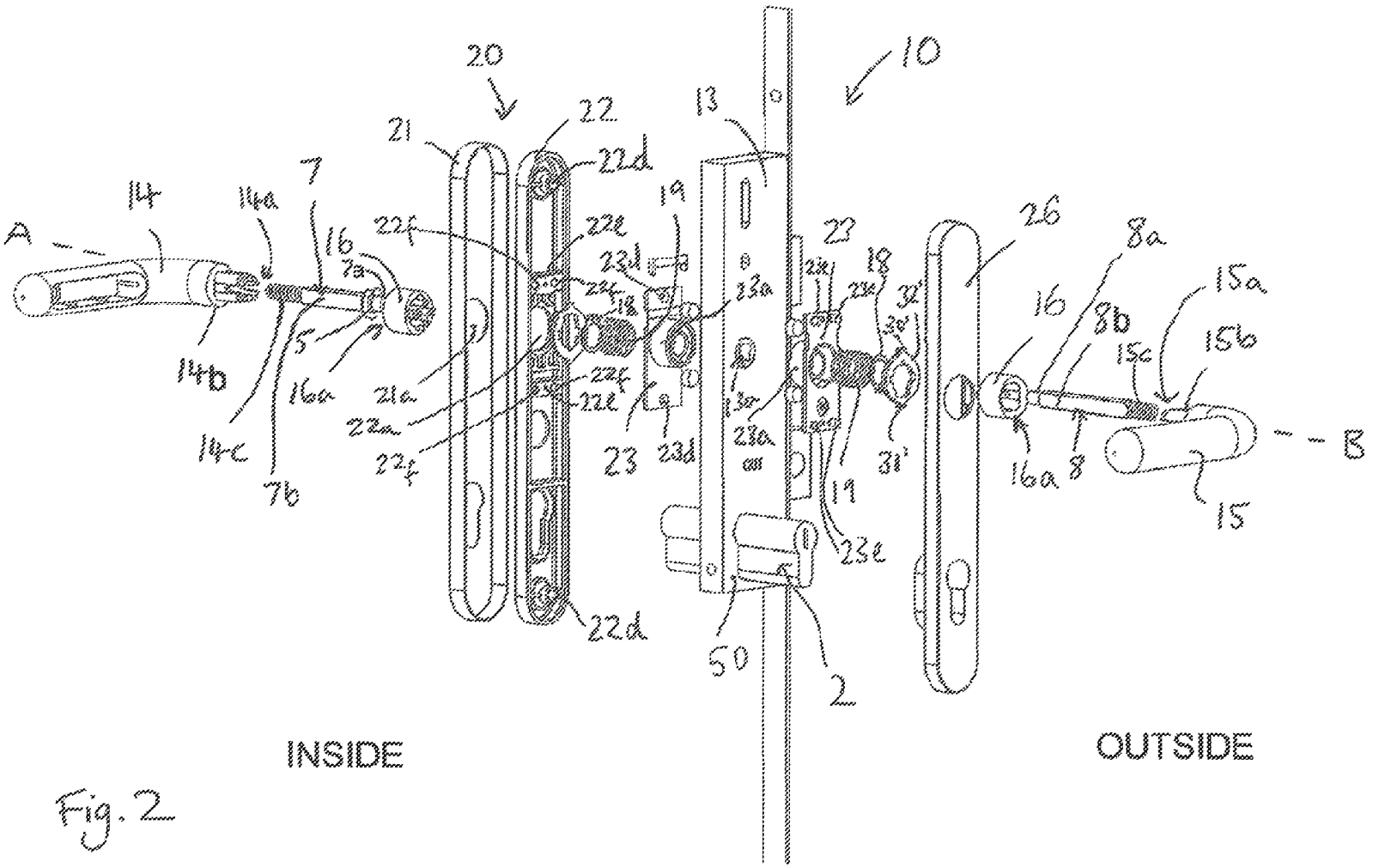

FIG. 2 shows an exploded view of a handle assembly 10 according to a first embodiment of the invention. Referring to FIG. 2, the first handle grip 14 is pivotally mounted relative to the internal housing 20 via a nose portion 14*b* which is received by the internal housing 20. The first handle grip 14 is moveable about a first handle axis A between a first angular position, corresponding to a 'closed' position for the handle grip in which the latch means 11 is in its latching position, and a second angular position, corresponding to an 'open' position in which the latch means 11 is retracted and therefore in its unlatched position. In the present embodiment, the lever of the first handle grip 14 is horizontal when in its closed position, however the first handle grip 14 may be at other orientations when in the closed position. In the present embodiment the handle grip 14 is in its open position when the first handle grip is depressed to rotate about 45 degrees from the horizontal position, however the open position may be at other angles relative to the closed position.

The second handle grip 15 is similarly pivotally mounted relative to the external housing 26 about a second handle axis B (which in this embodiment is coaxial with the first handle axis A). The second handle grip 15 is rotatable about second handle axis B between a closed position (as shown in FIG. 2) and an open position in which the second handle grip is depressed to rotate from the horizontal position.

Figure 1A:
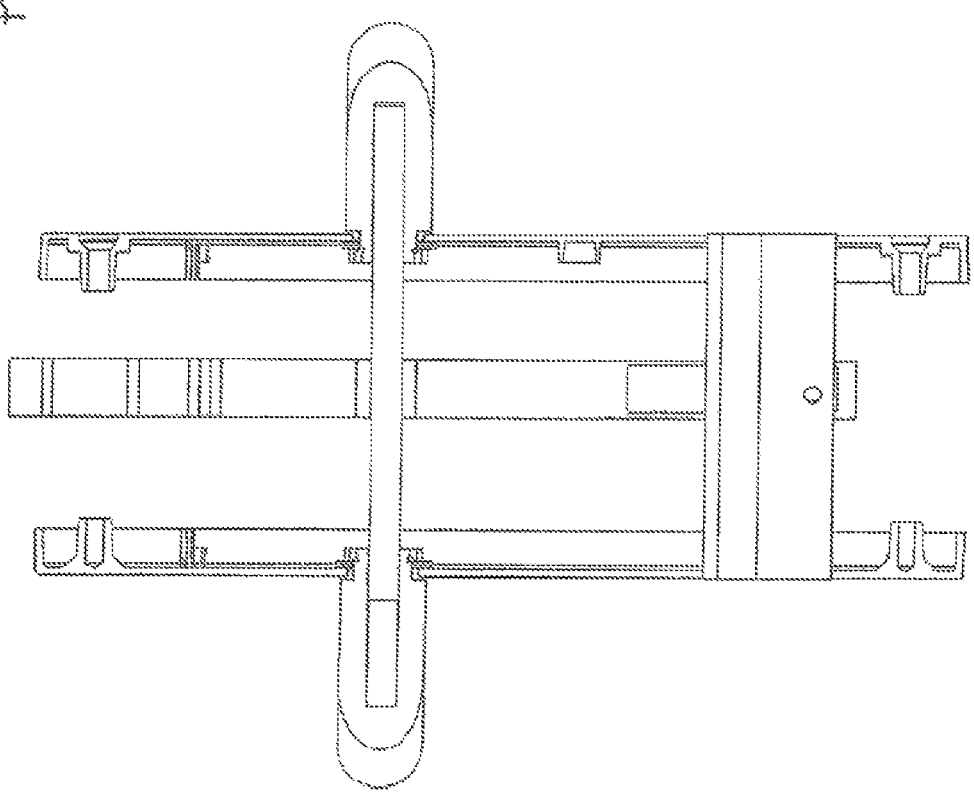
FIG. 1A is a cross-sectional view through a door with a prior art handle assembly.

Referring to FIG. 2, the internal housing 20 comprises an outer cover plate 21 and an inner cover plate 22 and a back plate 23. The inner cover plate 22 is arranged to be positioned over the back plate 23, the inner cover 22 plate being shaped to form a cavity therein to house certain parts of the handle assembly mechanism. The outer cover plate 21 is shaped and sized to fit over the inner cover plate 22. The inner cover plate 22 has throughbores 22*d* for receiving suitable fixings, such as screws, to secure the inner cover plate 22 to the leaf. The outer cover plate 21 is secured over the inner cover plate 22, for example via an interference fit. The back plate 23 has throughbores 23*d* and the inner clover plate has throughbores 22*e* for receiving suitable fixings, such as screws, to secure the back plate 23 to the inner cover plate 22. Referring to FIG. 2, the back plate 23 has a plurality of lugs (in this embodiment, four lugs, not visible in FIG. 1), which are receivable in bores 22*f* in the inner cover plate 22, to locate the back plate 23 relative to the inner cover plate 22 and to prevent rotation of the back plate 23 relative to the inner cover plate 22, as the handle mechanism is operated. The outer cover plate 21 and inner cover plate 22 each have a bore 21*a*, 22*a* therein through which is received the nose portion 14*b* of the first handle grip 14. In other embodiments, the inner cover plate 22 and outer cover plate 21 could be provided as a unitary piece. Around the nose portion 14*b* of the first handle grip 14 is received a bush 16 which has a circular outer cross-section for receipt within the circular through bores 21*a* and 22*a* in the outer and inner cover plates respectively. The first handle grip 14 and bush 16 are coupled together using circlip 18. The bush 16 has a throughbore 16*a* of rounded square cross-section (however it may be other polygonal shapes) which is configured to be received around the nose portion 14*b* of the first handle grip 14 which has a corresponding outer cross-sectional shape. A return spring 19 is provided to urge the first handle grip 14 into its closed position. Such return springs are standard within door handle assemblies, but other biasing means may be employed.

Referring to FIG. 2, the second handle grip 15 is pivotally mounted to an external housing 26 via a nose portion 15*b*. Around the nose portion 15*b* of the second handle grip is received a bush 16, similar to that associated with the first handle grip 14 as described above, coupled together using circlip 18. As for the internal side of the assembly, a return spring 19 is provided to urge the second handle grip 15 into its closed position. The external housing 26 is configured to be positioned over a back plate 23, similar to that associated with the first handle grip 14, the external back plate 23 also having throughbores 23*d* for receiving suitable fixings to secure it to the housing 26 and having a plurality of lugs 23*e* which are receivable in bores (not visible in FIG. 2) in the external housing 26, to locate the back plate 23 relative to the housing 26 and to prevent rotation of the back plate 23 relative to the housing as the handle mechanism is operated.

The back plate 23 of the external part of the handle assembly 10 has a cylindrical protruding portion 23*a* extending from the rearward side in the rearward direction, forming a cavity therein on the forward side with an opening facing forwardly. The cylindrical portion 23*a* receives the return spring 19, which in this embodiment is a helical compression spring, the rearward end of the spring 19 engaging the rearward side of the cylindrical portion 23*a* and the forward end of the spring 19 engaging the rearward side of bush 16. The spring 19 biases the second handle grip 15 away from the back plate 23.

The back plate 23 on the internal side of the handle assembly is substantially the same, but a mirror image through a mirror plane passing through the leaf.

The spindle means is a drive shaft, at least a portion of which has a square cross-section which couples to the handle grips and the drive mechanism 13 in use, for driving the latch means 11 between its latched and unlatched positions. The square shaped spindle part(s) and corresponding receiving bores may of course be of cross-sectional shapes other than square suitable for keying with a correspondingly shaped spindle bore, such as other polygonal shapes. Referring to FIG. 2, the spindle means 12 comprises a first spindle 7 (an internal spindle) that is received in a spindle bore 14*a* of the first (internal) handle grip 14 and a second spindle 8 (an external spindle) that is received in a spindle bore 15*a* of the second (external) handle grip 15. In other embodiments the spindle means 12 may instead comprise a single spindle that extends between from the spindle bore 14*a* of the internal handle grip 14 and into the spindle bore 15*a* of the external hand grip 15. Between the rearward end of the first spindle 7 and the end of spindle bore 14*a* is a compression spring 14*c* which urges the first spindle away from the first handle grip 14. The first spindle 7 has a C-shaped stop clip 5 received around the spindle towards its forward end to prevent the first spindle 7 from extending into the drive mechanism 13 beyond the stop clip 5. The first spindle 7 is coupled relative to the first handle grip 14 such that as the first handle grip 14 is rotated or translated axially, the first spindle 7 will move with it.

The second spindle 8 is coupled relative to the second handle grip 15 such that as the second handle grip 15 is rotated the second spindle 8 will move with it. Between the forward end of the second spindle 8 and the end of spindle bore 15*a* is a compression spring 15*c* which urges the second spindle 8 away from the second handle grip 15. At the rearward end of the second spindle 8 is a first portion 8*a* having a cross-sectional shape transverse to its longitudinal axis configured so that it can be received in a spindle bore 13*a* in the drive mechanism but such that it does not key with the spindle bore 13*a*, but instead can rotate freely therein. In this embodiment the first portion 8*a* has a circular cross-section, having a diameter slightly smaller than the width of the square spindle bore 13*a*. Adjacent the first portion 8*a* is a second portion 8*b* that is shaped in its cross-section so as to engage with the spindle bore 13*a* via a keying engagement. In this embodiment the second portion 8*b* has a square cross-section to key with the square spindle bore 13*a*.

The first spindle 7 also has a first portion 7*a* having a cross-sectional shape configured so that it can be received in a spindle bore 13*a* in the drive mechanism but such that it does not key with the spindle bore 13*a*, but instead can rotate freely therein. Adjacent the first portion 7*a* of the first spindle is a second portion 7*b* shaped in its cross-section so as to engage with the spindle bore 13*a* via a keying engagement. The first portion 7*a* has a circular cross-section and the second portion 7*b* has a square cross-section. In this embodiment the first portion 7*a* of the first spindle 7 is shorter than the first portion 8*a* of the second spindle 8.

Figure 5C:
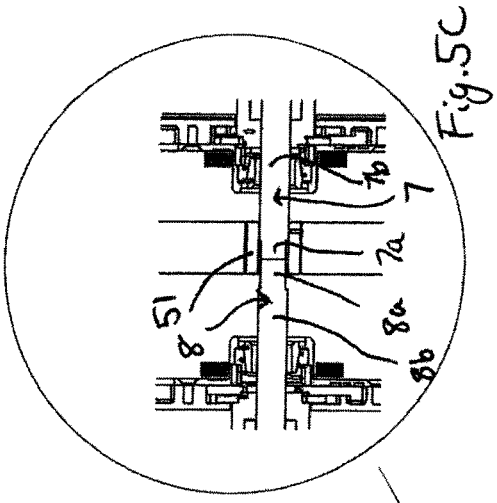
FIG. 5C is a close-up view of FIG. 5B showing the first and second spindles.
Figure 5D:
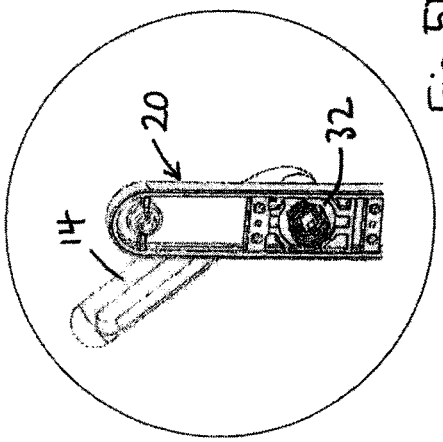
Figure 5B:
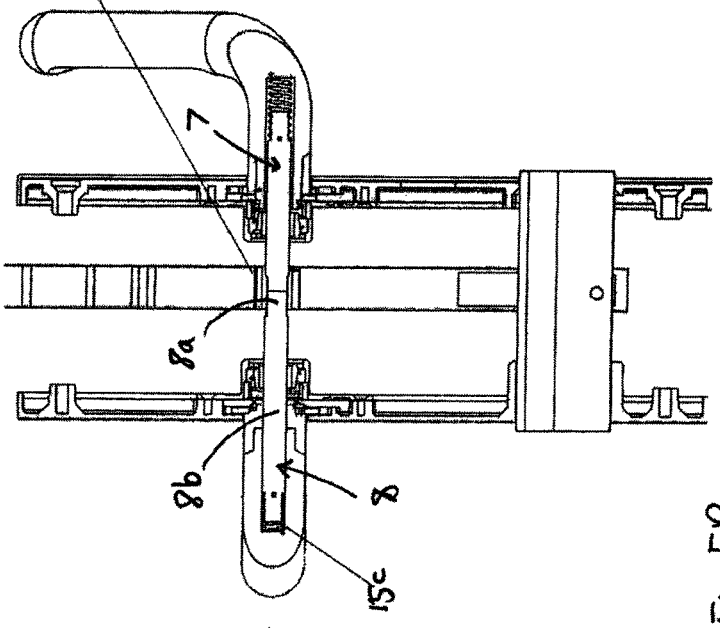
FIG. 5B is a cross-sectional view of the handle assembly in locked mode.
Figure 5A:
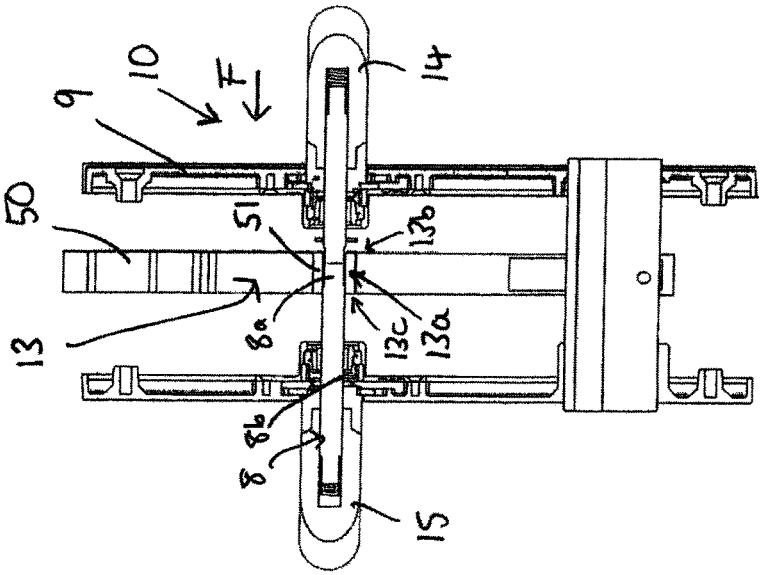
FIG. 5A is a cross-sectional view of the handle assembly in rest mode.

FIG. 5A shows a cross-section through the handle assembly 10 mounted in a leaf 9 when the handle assembly 10 is in its rest mode. The drive mechanism 13 has a collar 51 (also known as a drive cam) in which is a spindle bore 13*a*. The spindle bore 13*a* has an opening 13*b* on its rearward side for receiving the forward end of the first spindle 7 and an opening 13*c* on its forward side for receiving the rearward end of the second spindle 8. The collar 51 is rotatable relative to the drive mechanism housing 50 upon rotation of a spindle when engaged in the spindle bore 13*a*. In the rest mode a rearward portion of the second spindle 8 is received in the spindle bore 13*a*. In the rest mode the whole of the narrowed first portion 8*a* and a short section of the adjacent second portion 8*b* of the second spindle is received in the spindle bore 13*a*. The square cross-sectioned second portion 8*b* engages in the spindle bore 13*a* via keying engagement so that the second handle grip 15 can be used to drive the latch means. The forward end of the first spindle 7 engages the rearward end of the second spindle 8, both spindles being arranged coaxially along a common axis.

In order to convert the handle assembly 10 from rest mode to the locked mode, in which the second handle grip 15 is prevented from being operable to drive the latch means, firstly the first handle grip 14 is pushed forwards relative to the handle assembly 10, axially along the first handle axis A in the direction of arrow F in FIG. 5A. The handle assembly 10 is shown in locked mode in FIG. 5B. When the first handle grip 14 is pushed forwards by a user, this causes the first spindle 7 to be translated axially forwards relative to the handle assembly 10, which pushes the second spindle 8 forwards. The second spindle 8 is pushed further into the spindle bore 15*a* in the second handle grip, compressing spring 15*c* (also known as a ride over spring) and reducing the length of its rearward portion of the second spindle 8 received in the spindle bore 13*a* so that only the narrowed first portion 8*a* of the second spindle 8 is received in the spindle bore 13*a*. The second spindle 8 is therefore disengaged from the drive mechanism 13 as no part of the second portion 8*b* is received in the spindle bore 13*a*. While the first handle grip 14 is pushed in as shown in FIG. 5B, if a person tries to turn the second handle grip 15 from its closed position to its open position, the second handle grip 15 will be rotatable but rotation will not drive the latch means, unlike in the rest mode. In other embodiments the handle assembly may be configured such that the second handle grip 15 will not be rotatable between its closed position and its open position when the assembly is in its locked mode. Instead, in the locked mode the second handle grip 15 would be fixed in its closed position. In such embodiments the handle assembly does not include springs 14*c* and 15*c* and instead of spring 14*c* there is a solid part which effectively blocks rotation of the second handle grip when the assembly is in the locked mode.

The handle assembly 10 is configured such that by carrying out a further step in the transition from rest mode to locked mode, the handle assembly 10 can be retained in the locked mode. The further step, after pushing the first handle grip 14 in towards the leaf, is to rotate the first handle grip 14 into a third angular position, as shown in FIG. 3B. The third position of the first handle grip 14 is reached by lifting the first handle grip 14 towards the top of the leaf. The handle assembly 10 is designed for use with a multi-point lock system having a plurality of hook bolts (not shown in the figures) or other latch means arranged on a drive rail that is actuated by the drive mechanism 13 such that upon movement of the first or second handle grip 14, 15 into the third position this throws the hook bolts into corresponding keeps mounted in the door frame. Therefore, in this embodiment, upon movement of the first handle grip 14 into the third position the hook bolts are thrown and the handle assembly 10 is moved into a configuration in which the handle assembly 10 is retained in the locked mode.

Referring to FIGS. 3B, 3C and 3D, upon movement of the first handle grip 14 into the third position the collar 51 in the drive mechanism 13 rotates. As can be seen from FIGS. 3B and 3D, once the collar 51 of square cross-section has been rotated, the translationally displaced second portion 8*b* of the second spindle 8 is blocked from entering the spindle bore 13*a*. Therefore, while the first handle grip 14 is in the third position, the handle assembly 10 is retained in the locked mode. The handle assembly 10 also has means for retaining the first handle grip 14 in the third position, involving blocking means, as will be further described below.

The blocking means that, inter alia, retains the first handle grip 14 in the third position, has at least one blocking configuration in which the first handle grip 14 is prevented from being moved out of a predetermined position and a non-blocking configuration in which the first handle grip 14 is free to be rotated. In this embodiment the blocking means has two blocking configurations: a locked blocking configuration in which the first handle grip 14 is prevented from being moved out of its third position and a child safety blocking configuration in which the first handle grip 14 is prevented from being moved out of its closed position.

The blocking means comprises at least a first stop member and at least a first blocking formation, said blocking formation being coupled to the first handle grip 14 for movement therewith and engageable with the first stop member when the blocking means is in a blocking configuration. Referring to FIG. 3F, in this embodiment there are two blocking formations comprising first and second protrusions 30, 31 projecting radially away from the first handle axis A. The protrusions 30, 31 are formed on an annular body 32 that is received on the forwards end of bush 16 in use so that rotation or translation of the first handle grip 14 causes rotation or translation of the annular body 32 respectively. The annular body 32 has a throughbore through which the first spindle 7 sits in use. The first and second protrusions 30, 31 extend in opposing directions from the annular body 32.

The bush 16 has clips 16*a* for securing the annular body 32 thereto. The annular body 32 may alternatively be received around the first spindle 7. In alternative embodiments the protrusions 30, 31 may be arranged in some other manner such that they are coupled to rotate and translate as the first handle grip 14 does so.

Figures 4A, 4B, 4C, 4D, 4E, 4F, 4G:
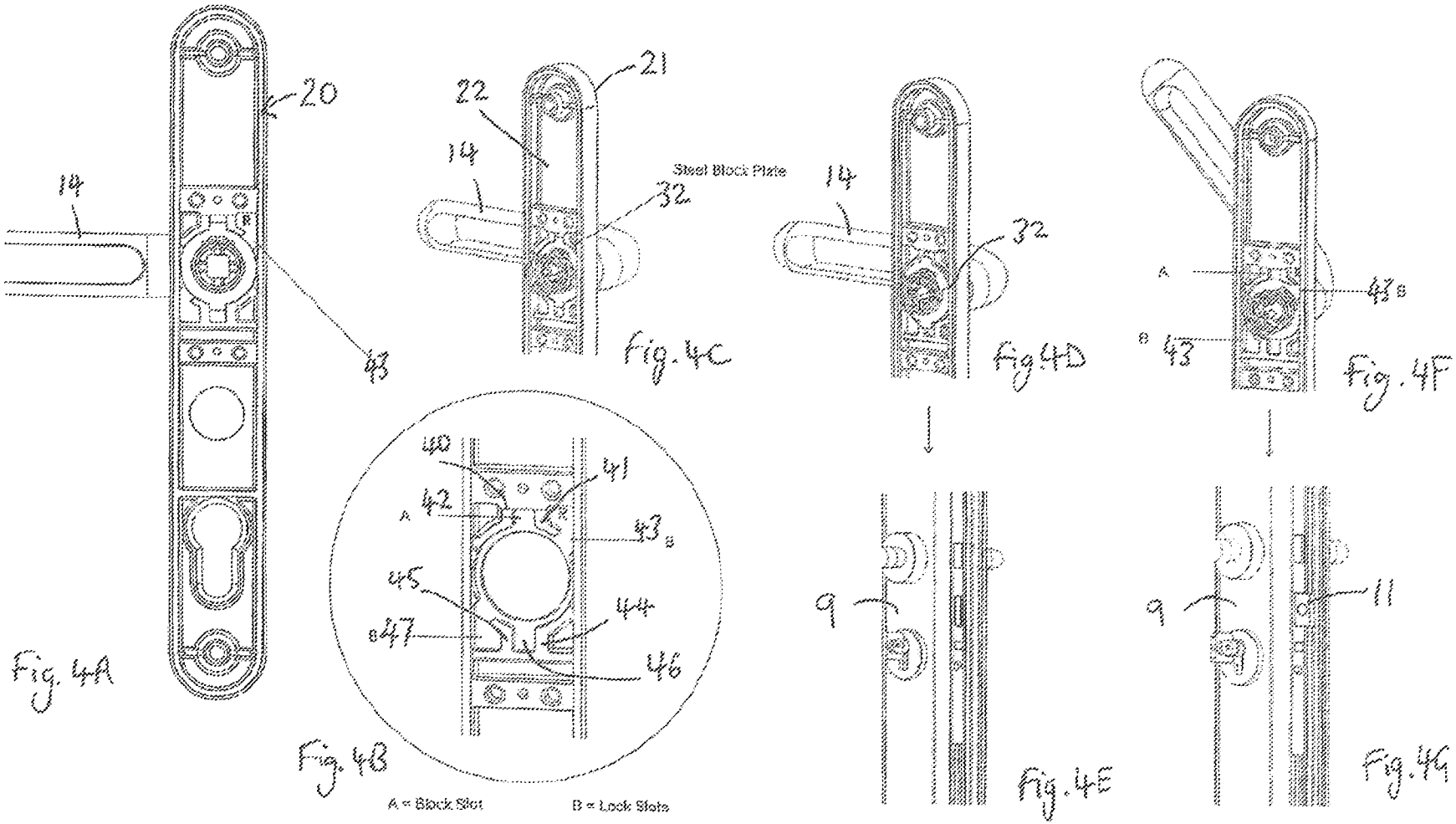

Referring to FIG. 4B, the inner cover plate 22 comprises first and second stop members 40, 41 for contacting the first protrusion 30. The stop members 40, 41 comprise formations that protrude into the cavity of the housing 20 and block rotation of the first protrusion 30 when the first protrusion comes into contact with a stop member 40, 41. Between the first and second stop members 40, 41 is a blocking slot 42. When the handle assembly 10 is in the rest mode shown in FIG. 4A, the first protrusion 30 is located in the blocking slot 42 between the first and second stop members 40, 41. The first protrusion 40 is positioned to block rotation of the first protrusion 30 if attempt is made to rotate the first handle grip 14 from its closed position to its open position. The second stop member 41 is positioned to block rotation of the first protrusion 30 if attempt is made to rotate the first handle grip 14 from its closed position to its third position. When in this configuration, the blocking means is in the child safety blocking configuration. This is a safety feature that makes it difficult for young children to open the door from the internal side. The blocking means is converted from the child safety blocking configuration to its non-blocking configuration by pushing the first handle grip 14 axially forwards. This moves the annular body 32 forwards to an axially depressed position relative to the inner cover plate 22. When the blocking means is in the child safety blocking configuration, the first protrusion 30 is aligned such that it is coplanar with the first and second stop members 40, 41, in a plane parallel with the leaf. When the assembly is in the non-blocking configuration, the first protrusion 30 is displaced from its position co-planar with first and second stop members 40, 41, such that when a rotational force is applied to the first protrusion 30, it is free to rotate in either direction.

Referring to FIG. 5B, when the first handle grip 14 is pushed axially forwards so that the blocking means is in the non-blocking configuration, the handle assembly 10 is also in the locked mode, in which the second handle grip 15 is prevented from being operable to drive the latch means (as the second spindle 8 is not engaged in the drive mechanism 13). The function of the blocking means to retain the handle assembly in locked mode will now be described. Referring to FIG. 4B, adjacent the second stop member 41 is a locking slot 43 which is shaped to receive the first protrusion 30. When the blocking means is in the non-blocking configuration as shown in FIG. 4D, the first handle grip 14 having been pushed axially forwards relative to the leaf, the first handle grip 14 is lifted upwards into its third position, at which point the first protrusion 30 aligns with the locking slot 43. If the first handle grip 14 is released by the user when in this position, biasing means which biases the first handle grip 14 away from the leaf will cause the first protrusion to enter locking slot 43. The first handle grip 14 is biased to return to its closed position, however second stop member 41 contacts the first protrusion 30, preventing the first handle grip from returning to its closed position. This therefore retains the first handle grip 14 in the third position, therefore retaining the collar 51 in the drive mechanism 13 in a rotationally displaced orientation with reference to the second portion 8*b* of second spindle 8 as shown in FIG. 3C, therefore retaining the handle assembly 10 in the locked mode.

Referring to FIG. 4B, the inner cover plate 22 has a further pair of first and second stop members 44, 45 arranged to stop second protrusion 31 in the same way as first protrusion 30 is stopped by first and second stop members 40, 41. The second pair of first and second stop members 44, 45 have two-fold rotational symmetry with the first pair of first and second stop members 40, 41 about the first handle axis A. Similarly, there is a blocking slot 46 between stop members 44, 45 and a locking slot 47 adjacent stop member 45.

Referring to FIG. 2, the external side of the handle assembly 10 (i.e. the parts on the external side of the leaf) includes an annular body 32' like that on the internal side of the handle assembly. The external annular body 32' has first and second protrusions 30', 31' and the external housing 26 has stop members (not shown) which prevent the second handle grip 15 from being rotated out of its closed position until the second handle grip 15 is displaced axially rearwards (i.e. towards the leaf).

The handle assembly 10 may be adapted to work for an opposite handed door. For example, a mirror image of the inner cover plate 22 may be provided, with the offset slots 43, 47 on the opposite side of the inner cover plate 22 from that shown in FIGS. 1 to 5D.

Figure 6C:
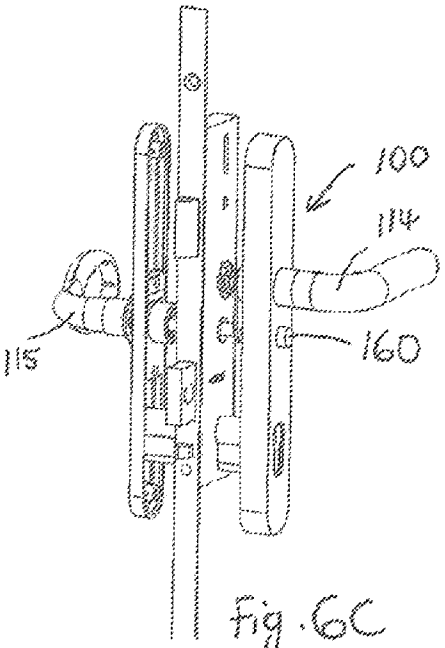
FIGS. 6A to 6C show a handle assembly for a multi-point lock system according to a further embodiment of the invention wherein the first and second spindles are non-coaxial.
Figure 6B:
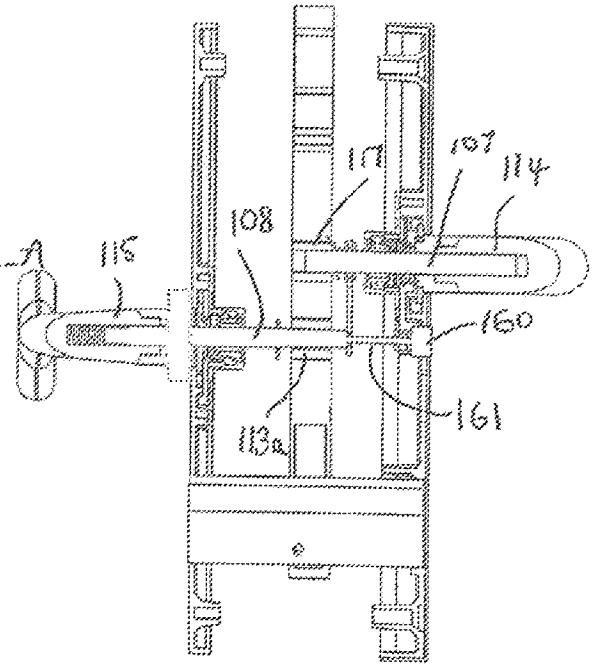
Figure 6A:
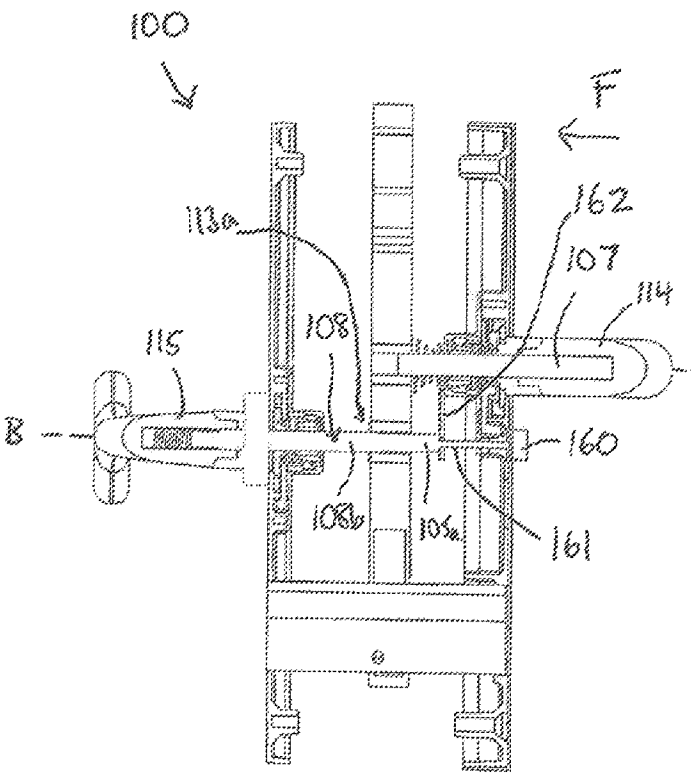

Referring to FIGS. 6A to 6C, a further handle assembly embodiment 100 is shown. Handle assembly 100 has first and second spindles 107, 108 coupled with first and second handle grips 114, 115 respectively that are non-coaxial. The first handle grip 114 is arranged to rotate about first handle axis A and the second handle grip 115 is arranged to rotate about second handle axis B. The drive mechanism 113 is a twin cam gearbox having a first spindle bore 117 for receiving the first spindle 107 and a second spindle bore 113*a* for receiving the second spindle 108. Unlike the handle assembly 10 in which conversion of the handle assembly from rest mode to locked mode involves translating the first handle grip 14 axially forwards relative to the leaf, in the handle assembly 100 of FIGS. 6A-6C, the assembly is converted from rest mode to locked mode by actuating a button 160. Button 160 is accessible from the internal side of the leaf and is rigidly coupled to the second spindle 108 by a rod 161. Pushing button 160 forwards relative to the leaf causes the second spindle 108 to be translationally displaced forwards also.

As with the handle assembly 10 of the embodiment of FIGS. 2 to 5D, at the forward end of the second spindle 108 is a first portion 108*a* having a circular cross-sectional shape, having a diameter slightly smaller than the width of the square spindle bore 113*a*. Adjacent the first portion 108*a* is a second portion 108*b* that is shaped in its cross-section so as to engage with the spindle bore 113*a* via a keying engagement. In this embodiment the second portion 108*b* has a square cross-section to key with the square spindle bore 113*a*.

In the rest mode as shown in FIG. 6A the whole of the narrowed first portion 108*a* and a short section of the adjacent second portion 108*b* of the second spindle is received in the spindle bore 113*a*. The square cross-sectioned second portion 108*b* engages in the spindle bore 113*a* via keying engagement so that the second handle grip 15 can be used to drive the latch means.

In order to convert the handle assembly 100 from rest mode to the locked mode, in which the second handle grip 115 is prevented from being used to operate the drive mechanism, the button 160 is pushed axially forwards relative to the leaf along second handle axis B along the direction of arrow F. The handle assembly 100 is shown in locked mode in FIG. 6B. When the button 160 is pushed forwards by a user, this causes the second spindle 108 to be translated axially forwards relative to the handle assembly 100. The second spindle 108 is disengaged from the drive mechanism 113 as no part of the second portion 108*b* is received in the second spindle bore 113*a*. Therefore, in locked mode the second handle grip 115 is prevented from being operable to drive the latch means.

The button 160 is configured such that it latches in its depressed configuration as shown in FIG. 6B once it has been depressed, so that it remains in its depressed configuration even if a depressing force is removed. When in this configuration, pressing of the button 160 again will release it to its released configuration as shown in FIG. 6A. The handle assembly 100 includes biasing means that biases the second handle grip 115 towards the leaf, therefore on release of the button 160, the handle assembly returns to rest mode as shown in FIG. 6A.

The button 160 for conversion of the handle assembly 100 between rest and locked mode can be provided instead of or in addition to a mechanism involving translation of the first handle grip 114 axially forwards relative to the leaf in order to convert the handle assembly 100 between rest and locked mode. The handle assembly 100 of FIGS. 6A to 6C includes both options. The handle assembly 100 includes an arm 162 coupling the first spindle 107 and the second spindle 108. The arm 162 is arranged orthogonally to the first and second handle axes A, B. If the first handle grip 114 is translated axially forwards along first handle axis A, the arm 162 transfers the translational force to second spindle 108, therefore displacing the second spindle 108 forwards, thus converting the handle assembly from its rest mode to its locked mode.

Figure 7:
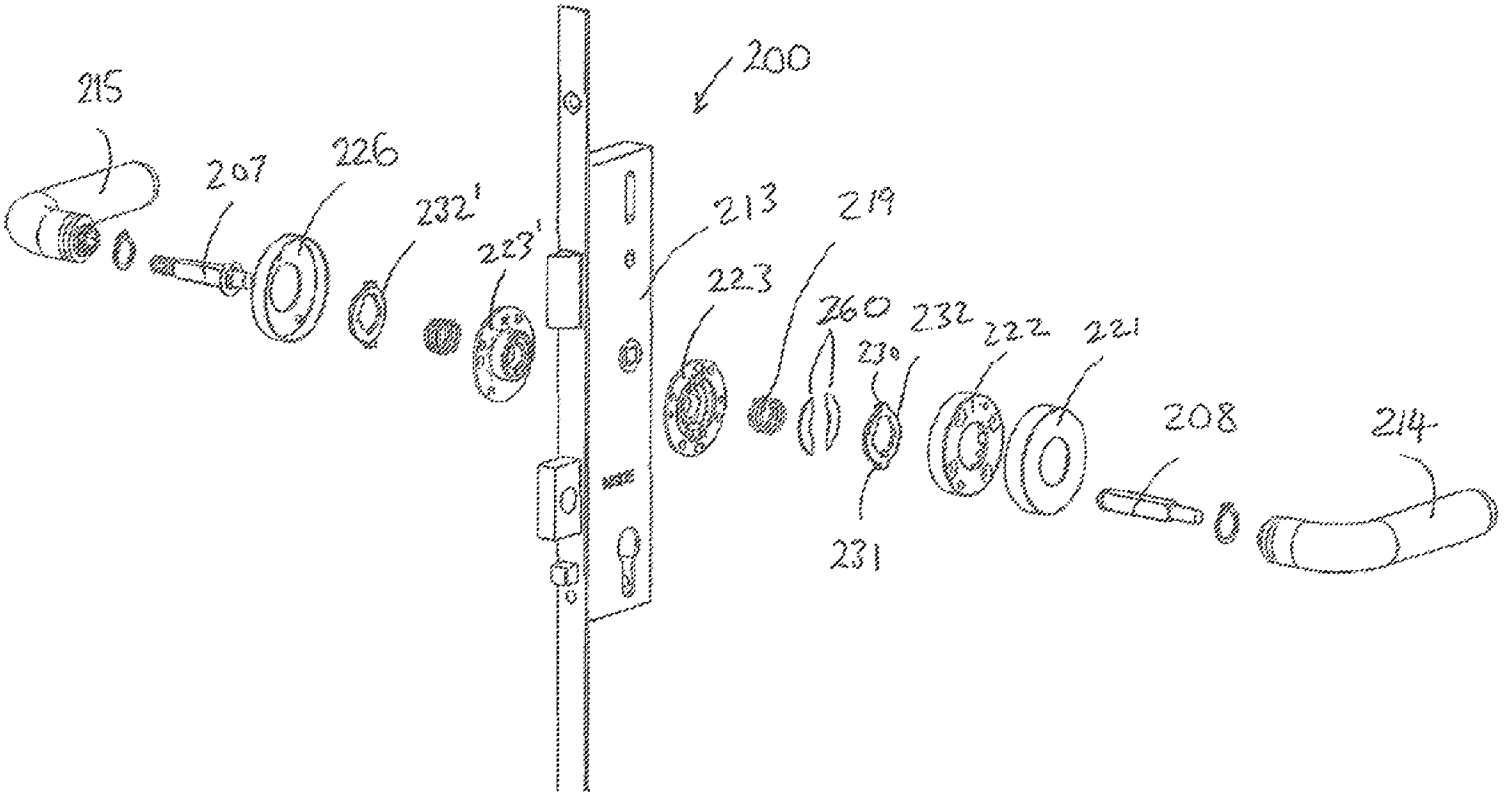
Figure 8C:
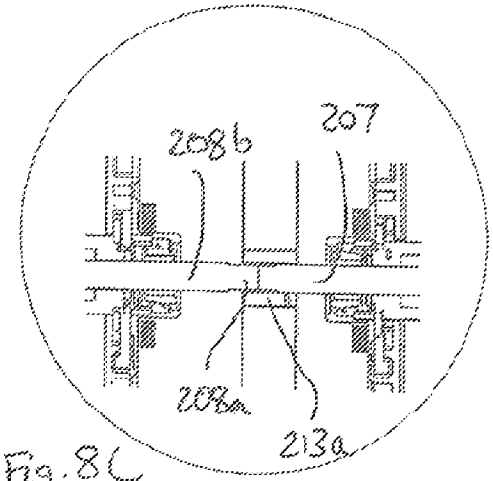
FIG. 8C is a close-up view of FIG. 8B showing the first and second spindles.
Figure 8D:
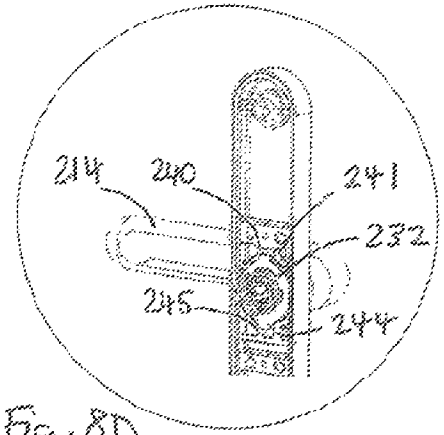

Referring to FIGS. 7 to 8D, a further handle assembly embodiment 200 is shown. Handle assembly 200 has first and second spindles 207, 208 coupled with first and second handle grips 214, 215 respectively that are coaxial. Like the embodiment of FIGS. 2 to 5D, in this embodiment conversion of the handle assembly from rest mode to locked mode involves translating the first handle grip 214 axially forwards relative to the leaf. The handle assembly 200 is designed for a standard type latch, rather than for a multi-point lock system as in the embodiment of FIGS. 2 to 5D. A standard type latch is one where the user presses the handle lever down to actuate the latch; unlike a handle assembly for a multi-point lock system, the handle lever is not lifted up in a standard type latch system.

As with the previous embodiments, the rearward end of the second spindle 208 is a first portion 208*a* having a circular cross-sectional shape, having a diameter slightly smaller than the width of the square spindle bore 213*a*. Adjacent the first portion 208*a* is a second portion 208*b* that is shaped in its cross-section so as to engage with the spindle bore 213*a* via a keying engagement. In this embodiment the second portion 208*b* has a square cross-section to key with the square spindle bore 213*a*.

Figure 8B:
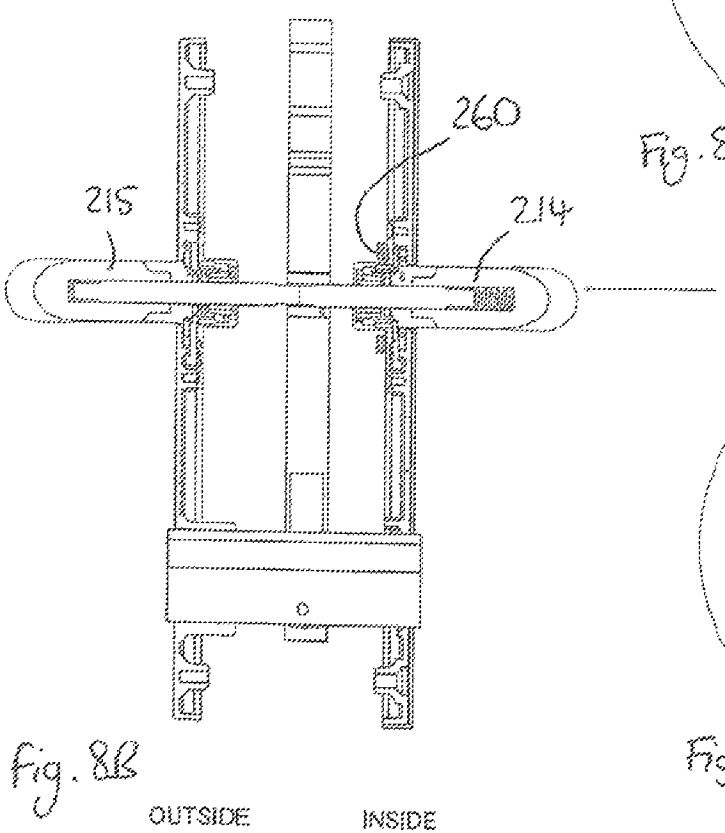
FIG. 8B shows a cross-sectional view of the handle assembly in locked mode.
Figure 8A:
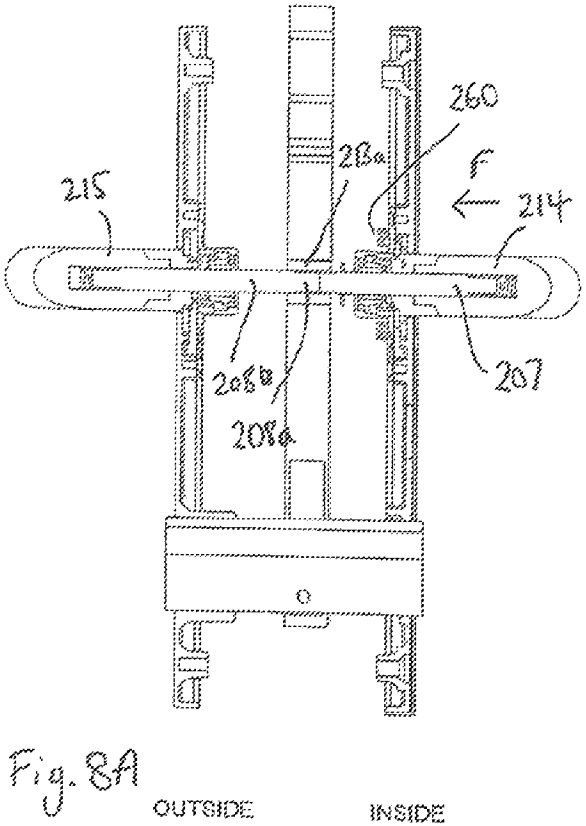
FIG. 8A shows a cross-sectional view of the handle assembly in rest mode.

In the rest mode as shown in FIG. 8A the whole of the narrowed first portion 208*a* and a short section of the adjacent second portion 208*b* of the second spindle is received in the spindle bore 213*a*. The square cross-sectioned second portion 208*b* engages in the spindle bore 213*a* via keying engagement so that the second handle grip 215 can be used to drive the latch means.

In order to convert the handle assembly 200 from rest mode to the locked mode, in which the second handle grip 215 is prevented from being used to operate the drive mechanism, the first handle grip 214 is pushed axially forwards relative to the leaf along handle axis A along the direction of arrow F. The handle assembly 100 is shown in locked mode in FIG. 7B. When the first handle grip 214 is pushed forwards by a user the forward movement of the first spindle 207 pushes the second spindle 208 axially forwards relative to the leaf. The second spindle 208 is disengaged from the drive mechanism 213 as no part of the second portion 208*b* is received in the second spindle bore 213*a*. Therefore, in locked mode the second handle grip 215 is prevented from being operable to drive the latch means.

The handle assembly 200 further comprises retaining means for retaining the handle assembly in the locked mode. The retaining means uses magnetic attraction to keep the handle assembly in the locked mode. Referring to FIG. 8A, the handle assembly 200 includes a magnet 260 mounted in between the inner cover plate 222 and the leaf (although it may be mounted elsewhere, but preferably in rigid association with the housing of the handle assembly on the internal side of the leaf). The handle assembly 200 further comprises a steel plate 232 mounted in rigid association with the first handle grip 214 such that the steel plate 232 moves translationally and/or rotationally when the first handle grip 214 is translated and/or rotated.

Referring to FIG. 8B, when the handle assembly 200 is in locked mode, the steel plate 232 comes into close proximity with the magnet 260. If the first handle grip 214 is released by the user, the first handle grip 214 will be retained in its forwardly depressed position relative to the leaf as shown in FIG. 8B by means of the magnetic attraction between the magnet 260 and the steel plate 232, therefore retaining the handle assembly 200 in the locked mode. The handle assembly 200 can be converted from the locked mode to the rest mode by the application of a small pulling force on the first handle grip 214 in order to overcome the magnetic attraction between the magnet 260 and the steel plate 232.

Instead of having a magnet on the housing and a ferromagnetic body carried by the first handle grip 214, there may be a ferromagnetic body on the housing and a magnet carried by the first handle grip 214. Alternatively, both elements may be magnetic, but with opposing polarities facing one another.

The steel plate 232 may be any sort of element that is magnetically attracted to the corresponding element 260 on the housing. In this embodiment, the steel plate 232 is an annular shaped body like annular body 32 of the embodiment of FIGS. 2 to 5D that acts as part of a blocking means. The steel plate 232 is an annular shaped body that mounts onto a nose portion or similar of the first handle grip 214. The steel plate 232 has first and second protrusions 230, 231 and the internal housing has stop members 240, 241, 244, 245 (visible in FIG. 8D) formed on back plate 223 which prevent the first handle grip 214 from being rotated out of its closed position until the first handle grip 214 is displaced axially forwards (i.e. towards the leaf). Referring to FIG. 7, similarly there is an identical steel plate 232' on the external side of the handle assembly 200 that is configured to interact with stop members (not shown) on a back plate 223' of the external housing in a similar way. This provides a child safety blocking configuration for the internal and external parts of the handle assembly as in previous embodiments.

This handle assembly provides an easy way to lock the door to prevent others from gaining entry from outside. A user of this system will not accidentally lock themselves out as the handle assembly does not remain locked after a user has used the first handle grip to exit the door (as the handle assembly would return to rest mode).

Referring to FIGS. 9A to 9E, a further handle assembly embodiment 300 is shown. Unlike each of the previous embodiments which have first and second spindles, the handle assembly 300 has a single spindle 312 which rotationally couples the first and second handle grips 314, 315. In this embodiment the handle assembly 300 is converted between the rest mode and the locked mode by translating the first handle grip 314 axially relative to the leaf as will be described.

Figures 9A, 9B, 9C, 9D, 9E:
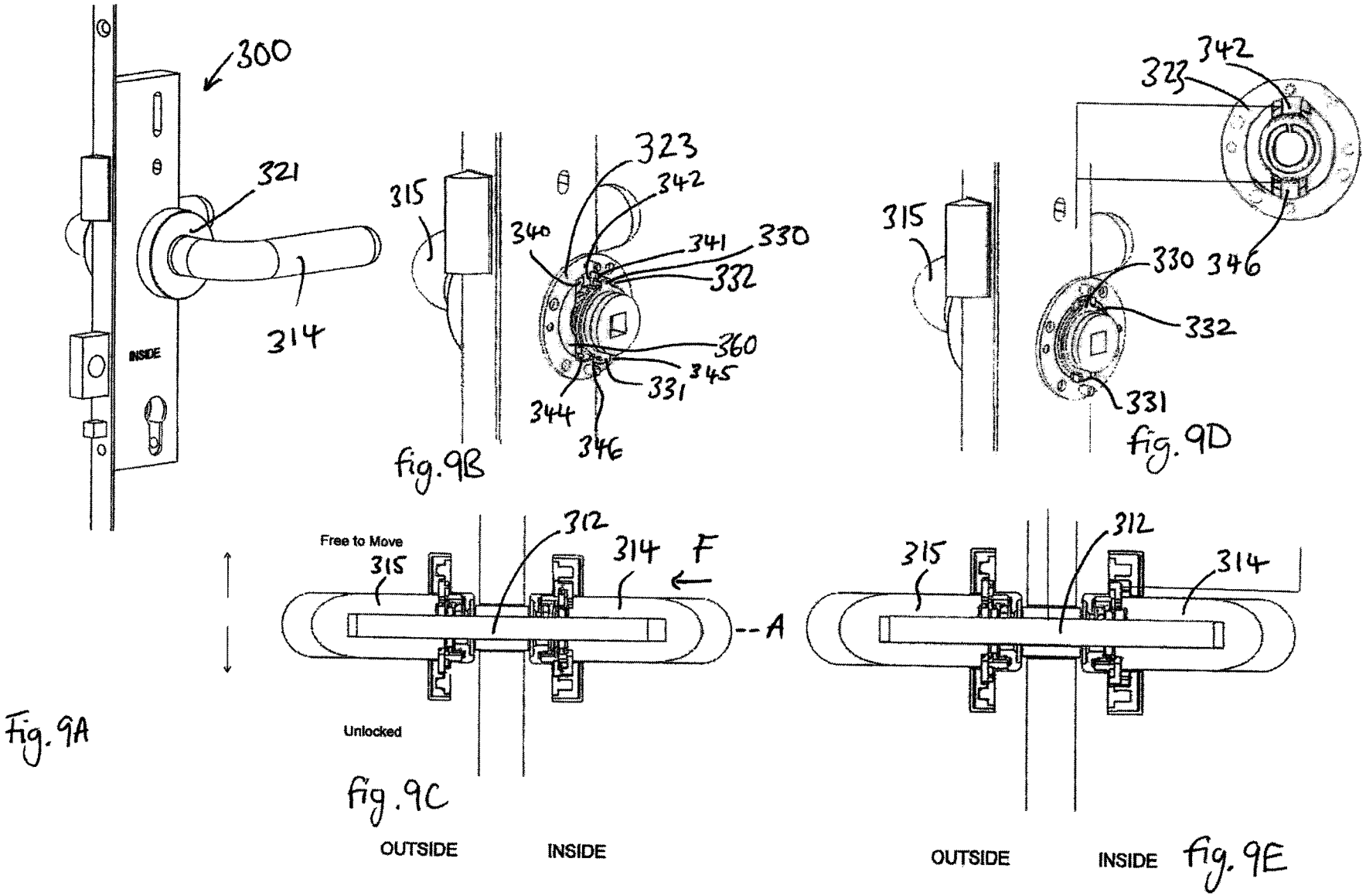
FIGS. 9A to 9E show a handle assembly for a standard type latch mechanism according to a further embodiment of the invention with a single spindle.

The handle assembly 300 includes blocking means transformable between a blocking configuration in which the first and second handle grips 314, 315 are not rotatable relative to the leaf and a non-blocking configuration in which the first and second handle grips 314, 315 are rotatable relative to the leaf. The blocking means is converted from the non-blocking configuration to the blocking configuration by translating the first handle grip 314 axially forwards relative to the leaf along handle axis A. The blocking means comprises an annular body 332 mounted on the forward end of the first handle grip 314 such that rotation or translation of the first handle grip 314 causes rotation or translation of the annular body 332 respectively. Like the annular body 32 of the embodiment of FIGS. 2 to 5D, the annular body 332 has first and second protrusions 330, 331 projecting radially away from it in opposing directions. Referring to FIGS. 9A and 9B, the handle assembly 300 further comprises a back plate 323 which mounts to the outer cover plate 321. The back plate 323 has first and second stop members 340, 341 arranged to interact with the first protrusion 330. Between first and second stop members 340, 341 is a blocking slot 342 sized to receive the first protrusion 330 therein when the blocking means is in the blocking configuration as shown in FIG. 9D. The back plate 323 further has a second set of stop members 344, 345 arranged to interact with the second protrusion 331 and with a blocking slot 346 between them.

When the handle assembly 300 is in rest mode as shown in FIGS. 9B and 9C the blocking means is in its non-blocking configuration, with the first and second protrusions 330, 331 outside of the plane which the stop members 340, 341, 344, 345 on the back plate 323 occupy. In order to convert the handle assembly 300 to the locking mode, the first handle grip 314 is pushed axially forwards along axis A in direction F, towards the leaf. This displaces the annular body 332 such that the first protrusion 330 is received in the blocking slot 342 between first and second stop members 340, 341, as shown in FIG. 8D. The second protrusion 331 is similarly received in blocking slot 346. In this configuration, the first handle grip 314 is now blocked from rotation from its closed position to its open position. Since the second handle grip 315 is rotationally coupled to the first handle grip 314 by spindle 312, the second handle grip 315 is also prevented from being rotatable from its closed position to its open position.

Like the handle assembly 200 of the embodiment of FIGS. 7 to 8D the handle assembly 300 has magnetic retaining means for retaining the handle assembly 300 in the locked mode. The handle assembly 300 has a magnet 360 mounted to the housing on the internal side of the handle assembly which retains the handle assembly in the locked mode via magnetic attraction between the magnet and the annular body 332, which is made of steel.

The first handle grip 314 is biased rearwardly away from the leaf by a spring so that if a small pulling force is applied to the first handle grip 314 in order to overcome the magnetic attraction between the magnet and the annular body 332 when the handle assembly is in the locked mode, the first handle grip 314 will be urged rearwardly and the handle assembly will return to its rest mode.

Rather than a single spindle, the handle assembly 300 may have a spindle means comprising more than one spindle portion rigidly secured together into a single integral piece.

Referring to FIGS. 10A to 10E, a further handle assembly embodiment 400 is shown. The handle assembly 400 is similar to the handle assembly 300 of FIGS. 9A to 9E except that the handle assembly 400 has first and second spindles 407, 408 rather than a single spindle. Like the handle assembly 300, handle assembly 400 is converted between the rest mode and the locked mode by translating the first handle grip 414 axially relative to the leaf. The internal side of the handle assembly 400 has a blocking means including annular body 432 with protrusions and back plate 423 with stop members which are the same as in the previous embodiment. The second spindle 408 has a first portion 408*a* at its rearward end having a circular cross-sectional shape and having a diameter slightly smaller than the width of the square spindle bore 413*a*. Adjacent the first portion 408*a* is a second portion 408*b* that is shaped in its cross-section so as to engage with the spindle bore 413*a* via a keying engagement. In this embodiment the second portion 408*b* has a square cross-section to key with the square spindle bore 413*a*.

Figures 10A, 10B, 10C, 10D, 10E:
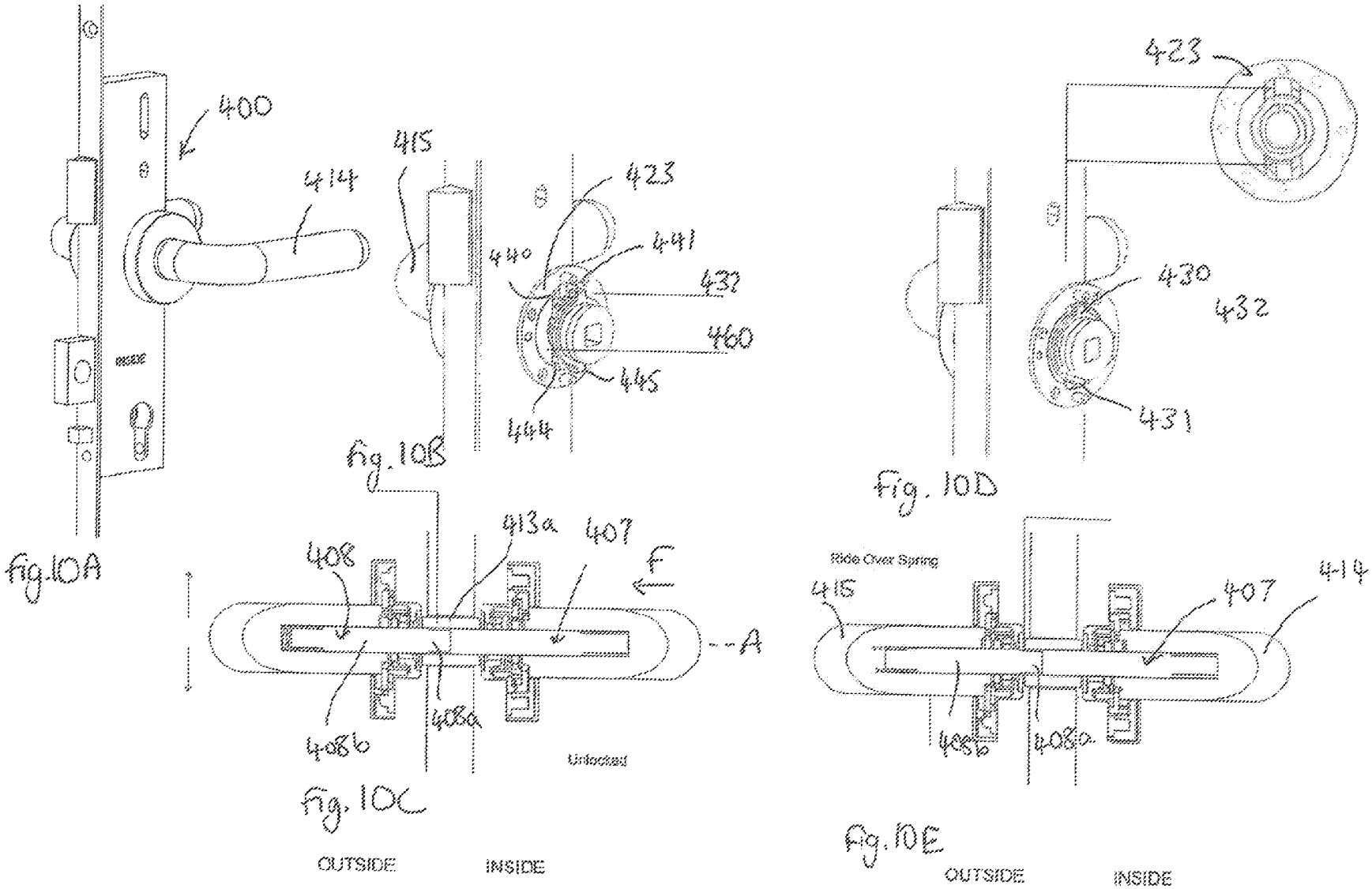
FIGS. 10A to 10E show a handle assembly for a standard type latch mechanism according to a further embodiment of the invention, similar to the FIG. 9 embodiment but with first and second spindles.

When the handle assembly 400 is in rest mode, as shown in FIGS. 10B and 10C, the blocking means is in its non-blocking configuration in the same way as described in relation to the embodiment in FIGS. 9B and 9C. Referring to FIG. 100, in the rest mode the whole of the narrowed first portion 408*a* and a short section of the adjacent second portion 408*b* of the second spindle is received in the spindle bore 413*a*. The square cross-sectioned second portion 408*b* engages in the spindle bore 413*a* via keying engagement so that the second handle grip 415 can be used to drive the latch means.

In order to convert the handle assembly 400 from rest mode to the locked mode, in which the second handle grip 415 is prevented from being used to operate the drive mechanism, the first handle grip 414 is pushed axially forwards relative to the leaf along handle axis A along the direction of arrow F. The handle assembly 400 is shown in locked mode in FIGS. 10D and 10E. When the first handle grip 414 is pushed forwards by a user the forward movement of the first spindle 407 pushes the second spindle 408 axially forwards relative to the leaf. The second spindle 408 is disengaged from the drive mechanism 413 as no part of the second portion 408*b* is received in the second spindle bore 413*a*. Therefore, in locked mode the second handle grip 415 is prevented from being operable to drive the latch means. Furthermore, the first handle grip 414 is prevented from turning from the closed position to the open position in the locked mode due to the contact of the first and second protrusions 430, 431 with the corresponding stop members 440, 441, 444, 445 on the back plate 423.

Like the handle assembly of the previous embodiment the handle assembly 400 has magnetic retaining means for retaining the handle assembly 400 in the locked mode. The handle assembly 400 has a magnet 460 mounted to the housing on the internal side of the handle assembly which retains the handle assembly in the locked mode via magnetic attraction between the magnet and the annular body 432, which is made of steel.

The first handle grip 414 is biased rearwardly away from the leaf by a spring so that if a small pulling force is applied to the first handle grip 414 in order to overcome the magnetic attraction between the magnet and the annular body 432 when the handle assembly is in the locked mode, the first handle grip 414 will be urged rearwardly and the handle assembly will return to its rest mode.

Figures 11A, 11B, 11C:
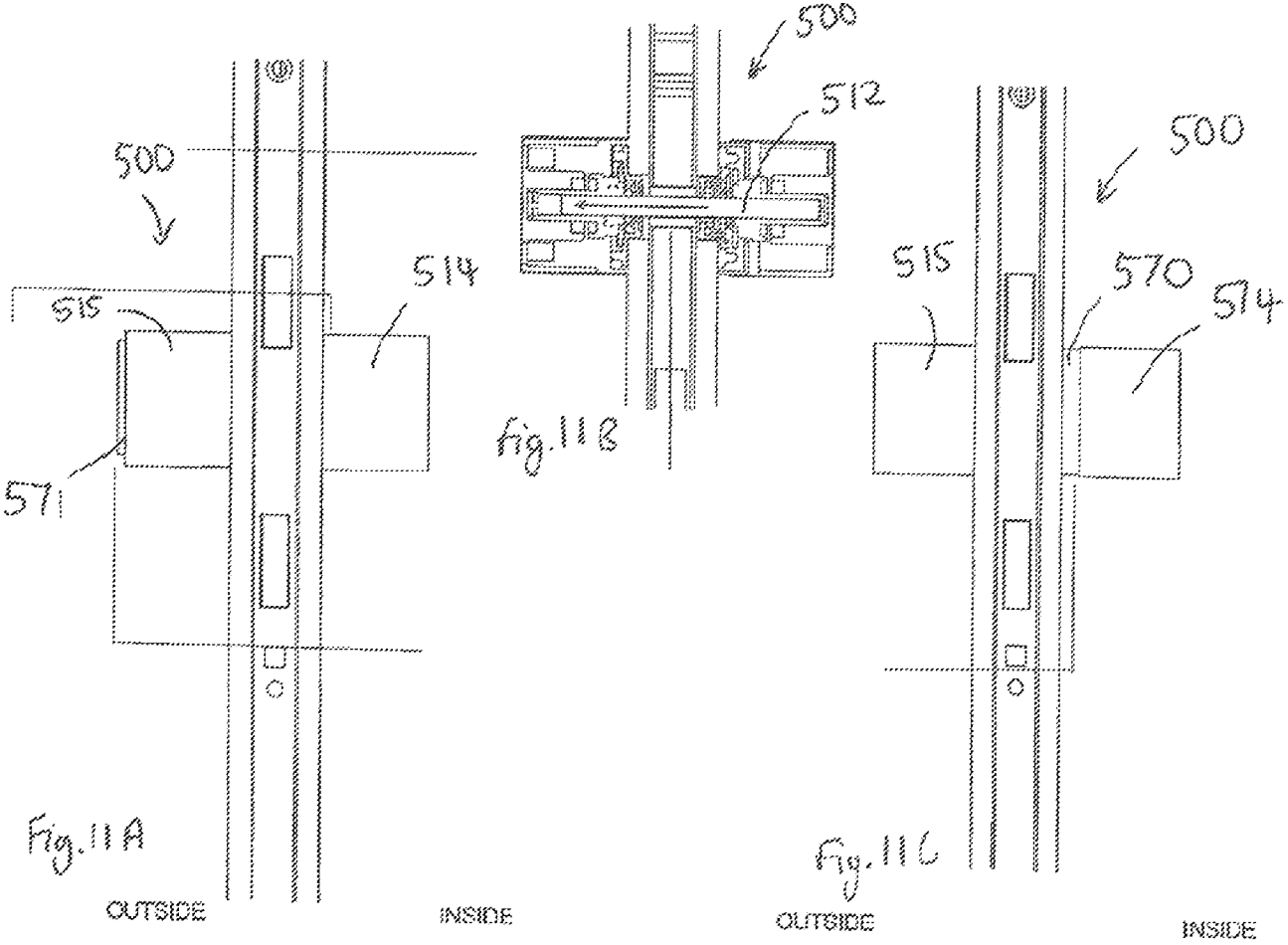
FIGS. 11A to 11C show a handle assembly including indicator means.

Any of the handle assemblies described above may include indicator means to indicate to a user whether the handle assembly is in the rest mode or locked mode. Indicator means will now be described with reference to FIGS. 11A to 11C.

A first example of indicator means is a visual indicator means comprising a rest mode indicator on the internal side of the assembly which if visible indicates that the handle assembly is in the rest mode, whereas if it is not visible, this indicates that the handle assembly is in the locked mode. The handle assembly 500 includes a first coloured ring 570 on the internal side of the assembly which is visible when the handle assembly 500 is in the rest mode as shown in FIG. 10C. The first coloured ring is arranged adjacent the leaf. When the handle assembly 500 is converted from the rest mode to the locked mode by translating the first handle grip 514 axially forwards relative to the leaf the first handle grip 514 covers the first coloured ring as shown in FIG. 10A, therefore indicating to a user on the internal side of the leaf that the handle assembly 500 is in the locked mode.

The handle assembly 500 further includes a second coloured ring 571 on the external side of the handle assembly. The second coloured ring 571 is located at the forward end of the second handle grip 515. The second coloured ring 571 is visible when the handle assembly is in the locked mode, as shown in FIG. 10A, but is covered by the second handle grip 515 when the handle assembly is in the rest mode as shown in FIG. 10C. Referring to FIG. 10B, when the handle assembly 500 is converted from the rest mode to the locked mode by translating the first handle grip 514 axially forwards relative to the leaf, the spindle means 512 is pushed forwards by movement of the first handle grip 514 forwards, which displaces the second coloured ring 571 axially forwards so that it is no longer covered by the second handle grip 515. If the second coloured ring 571 is visible, it indicates to a person on the external side of the leaf that the room is occupied/locked.

The first and second coloured rings 570, 571 may be different colours from one another. For example the first coloured ring 570 may be green and the second coloured ring 571 may be red.

Alternatively a handle assembly may have an electrical indicator means to indicate whether the handle assembly is in rest mode or locked mode. The electrical indicator means comprises a switch at the forward end of second handle grip. Referring to FIG. 10B, when the handle assembly is converted from rest mode to locked mode by translating the first handle grip 514 axially forwards relative to the leaf, the spindle means 512 is pushed forwards. When in the locked mode the forwards end of spindle means 512 contacts the switch (not shown in the Figures), which in turn actuates an output means to indicate to a user that the handle assembly is in locked mode. The output means may be an illuminating indicator such as an LED that is visible to the user on one side of the leaf (or there may be two LEDs, one on each side of the assembly). Alternatively, the output means may be an audible indicator such as a speaker.

Figure 12:
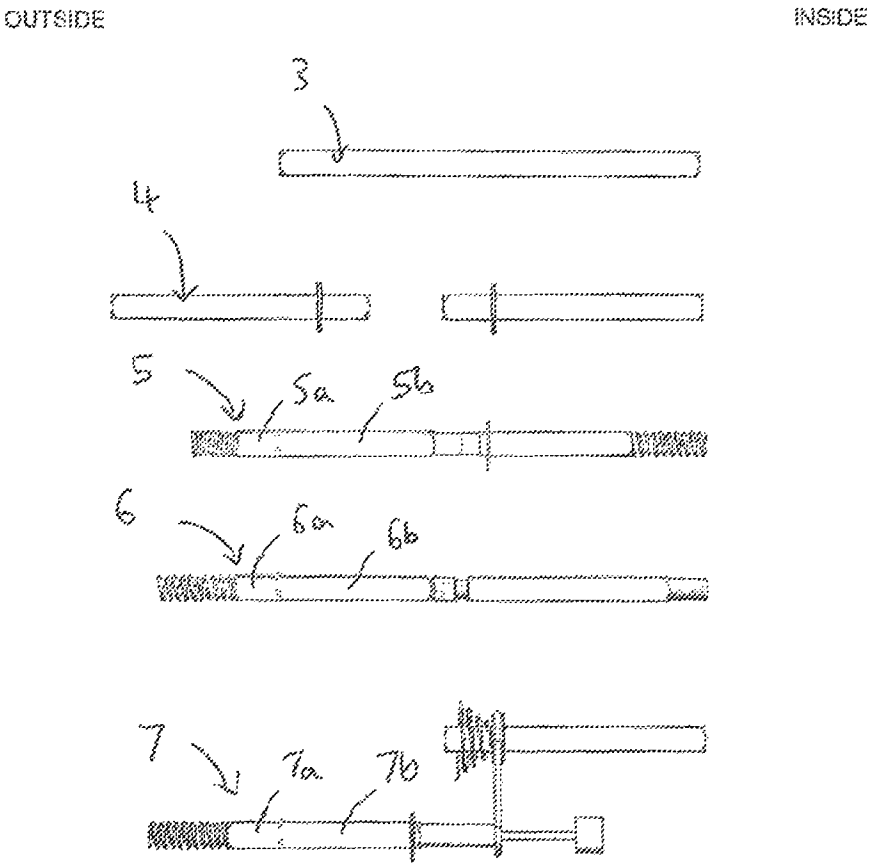
FIG. 12 shows various different spindle means that may be incorporated in the different embodiments.

According to a further aspect of the invention there is provided a spindle means for a handle assembly having a sacrificial portion and a remainder portion, the sacrificial portion being configured for breaking away from the remainder portion if an attempt is made to snap the spindle means. Referring to FIG. 12, various different types of spindle means 3 to 7 are shown. Spindle means 5, 6 and 7 each have a part that has been manufactured to be susceptible to being broken as a security mechanism to avoid an intruder attempting to gain entry via spindle snapping. Each of the spindle means 5, 6 and 7 has a sacrificial spindle portion 5*a*, 6*a*, 7*a* at its forward end and a remainder portion, the sacrificial portion being configured for breaking away from the remainder portion if an attempt is made by someone to snap the spindle. At the boundary between the sacrificial portion 5*a*, 6*a*, 7*a* and the remainder portion is a region of weakness 5*b*, 6*b*, 7*b*, such as a groove in the spindle means. Any of the spindle means of the handle assemblies of the present invention may incorporate spindles of this type.

All of the embodiments may include biasing means to bias the handle assembly into the rest mode so that it returns to rest mode if urged out of locked mode by a user.

In handle assemblies 10, 100, 200, 300, 400, the handle grips are shown as lever type handle grips, however it will be understood that they could be knob type handle grips.

The embodiments described above relate to pushing of an element of the handle assembly forwards towards the leaf to convert the handle assembly from rest mode to locked mode, however it will be understood that the assemblies described herein could be modified such that pulling of the internal handle grip or some other element relative to the leaf converts the handle assembly from the rest mode to the locked mode.

A handle assembly of the present invention may additionally include a secondary lock for additional security. For example, the handle assembly 10 has a lock 2 operable by a key for additional security.

All of the handle assemblies of the present invention can be adapted for use with left handed or right handed doors.

What is claimed:

1. A handle assembly for a window or door leaf having first and second opposing sides, the handle assembly having a forward end and a rearward end, the handle assembly comprising:

a first handle grip, configured for mounting to a first side of the door leaf, the first handle grip being moveable rotatably and axially relative to a first handle axis, and a second handle grip configured for mounting to the second side of the door leaf, the second handle grip being movable at least rotatably relative to a second handle axis, each handle grip having a closed position, wherein the handle grip is in a first angular position and an open position, wherein the handle grip is in a second angular position, the handle assembly having a rest mode in which at least the second handle grip is configured for driving a latch means between a latched position and a released position, and locked mode in which the second handle grip is prevented from being operable to drive the latch means, wherein the handle assembly is configured such that the handle assembly is transformed between the rest mode and the locked mode by moving at least a part of the handle assembly at least axially along the first handle axis or along an axis parallel with the first handle axis, wherein the handle assembly further comprises a first spindle that is rotated upon rotation of the first handle grip and a second spindle that is rotated upon rotation of the second handle grip, each spindle being engageable with a drive mechanism for driving the latch means, the first spindle being insertable through an opening on one side of the drive mechanism, the second spindle being insertable through the opening from an opposite side of the drive mechanism, wherein the handle assembly is configured such that transformation of the handle assembly from the rest mode to the locked mode causes the second spindle to be disengaged from the drive mechanism.

2. A handle assembly according to claim 1, wherein the handle assembly is configured such that it is transformable from the rest mode to the locked mode by one of moving the first handle grip axially forwards relative to the door leaf and axially rearwards relative to the door leaf.

3. A handle assembly according to claim 1, wherein transformation of the handle assembly from the rest mode to the locked mode causes the second spindle to be pushed forwards, disengaging the second spindle from the drive mechanism.

4. A handle assembly according to claim 3, wherein transformation of the handle assembly from the rest mode to the locked mode causes the second spindle to be pushed forwards by forwards movement of the first spindle.

5. A handle assembly according to claim 1, wherein the handle assembly further comprises retaining means for retaining the handle assembly in the locked mode.

6. A handle assembly according to claim 5, wherein the retaining means comprises a first element mounted in rigid association with the first handle grip in use and a second element mounted in rigid association with the door leaf in use, the first element and second element being adapted to cooperate with one another via magnetic attraction.

7. A handle assembly according to claim 6, wherein one of the first and second elements is magnetic and the other of the first and second elements is ferromagnetic.

8. A handle assembly according to claim 1, wherein the handle assembly is configured such that in order to transform the handle assembly from the rest mode to the locked mode the first handle grip is moved axially along the first handle axis then rotated.

9. A handle assembly according to claim 8, wherein the forward end of the first spindle has a cross-section shaped to engage with a spindle bore when received therein via keying engagement such that rotation of the first spindle when engaged in the spindle bore rotates a collar of the drive mechanism in which the spindle bore is located, the second spindle having at least a portion having a cross-section shaped to engage with the spindle bore when received therein via keying engagement such that rotation of the second spindle when engaged in the spindle bore rotates the collar, wherein the handle assembly is configured such that the handle assembly is transformed from the rest mode to the locked mode by moving the first handle grip axially along the first handle axis then rotating the first handle grip such that the collar is rotated out of alignment with said at least a portion of the second spindle whereby the second spindle cannot engage with the spindle bore when the assembly is in the locked mode.

10. A handle assembly according to claim 8, wherein the first handle grip has a third angular position, wherein when the first handle grip is moved into its third position, the handle assembly is configured such that it is retained in the locked mode until the first handle grip is moved away from its third position.

11. A handle assembly according to claim 10, wherein the first handle grip is moveable into its third position by moving the first handle grip rotatably relative to the handle assembly.

12. A handle assembly according to claim 1, wherein the handle assembly further comprises at least a first blocking means transformable between a first blocking configuration and a non-blocking configuration, wherein in the first or each blocking configuration rotation of the first handle grip is limited, and wherein the handle assembly is configured such that the blocking means is transformed between the first or each blocking configuration and the non-blocking configuration by moving the first handle grip axially along the first handle axis.

13. A handle assembly according to claim 12, wherein the blocking means comprises at least a first stop member and at least a first blocking formation, the at least a first blocking formation being coupled to the first handle grip for movement therewith, the first blocking formation being contactable with the first stop member when the blocking means is in its first blocking configuration, thereby limiting rotation of the first handle grip.

14. A handle assembly according to claim 13, wherein said blocking formation comprises a protrusion projecting radially along the first handle axis.

15. A handle assembly according to claim 14, wherein the handle assembly further comprises a rotatable body arranged such that it rotates upon rotation of the first handle grip, the protrusion projecting radially from the rotatable body.

16. A handle assembly according to claim 13, wherein the handle assembly further comprises a housing, the first handle grip being moveable rotatably and axially relative to the housing, the blocking formation being housed within said housing in use.

17. A handle assembly according to claim 16, wherein the first stop member is located on the housing and is configured for contacting the first blocking formation when the blocking means is in the first blocking configuration.

18. A handle assembly according to claim 17, wherein the first stop member is mounted to or integral with an inside surface of the housing.

19. A handle assembly according to claim 12, wherein the first handle grip has a third angular position, wherein when the first handle grip is moved into its third position, the handle assembly is configured such that it is retained in the locked mode until the first handle grip is moved away from its third position, where said first blocking configuration is a locked blocking configuration in which at least the first handle grip is prevented from being rotated away from its third position by the blocking means.

20. A handle assembly according to claim 19, wherein the blocking means is a retaining means for retaining the handle assembly in the locked mode.

21. A handle assembly according to claim 19, wherein the blocking means is further transformable into a child safety blocking configuration in which at least the first handle grip is prevented from being rotated away from its closed position by the blocking means.

22. A handle assembly according to claim 1, wherein the handle assembly comprises spindle means that rotatably couples the first and second handle grips in use such that the first and second handle axes are coaxial and align with a handle axis, wherein the assembly further comprises a first blocking means transformable between a first blocking configuration and a non-blocking configuration, wherein in the first blocking configuration the first and second handle grips are prevented from being rotated, and wherein the handle assembly is configured such that the blocking means is transformed between the blocking configuration and the non-blocking configuration by moving the first handle grip axially along the handle axis.

23. A handle assembly according to claim 22, wherein the handle assembly is configured such that the blocking means is transformed from the non-blocking configuration to the blocking configuration by moving the first handle grip forwards axially along the handle axis.

* * * * *